US008838006B2

(12) United States Patent
Kitamura

(10) Patent No.: US 8,838,006 B2
(45) Date of Patent: Sep. 16, 2014

(54) DEVELOPER COLLECTION DEVICE AND IMAGE FORMING APPARATUS

(75) Inventor: Makoto Kitamura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 105 days.

(21) Appl. No.: 13/612,983

(22) Filed: Sep. 13, 2012

(65) Prior Publication Data

US 2013/0071165 A1 Mar. 21, 2013

(30) Foreign Application Priority Data

Sep. 20, 2011 (JP) ..... 2011-204731

(51) Int. Cl.
*G03G 21/10* (2006.01)
*G03G 21/12* (2006.01)
*G03G 21/00* (2006.01)

(52) U.S. Cl.
CPC ..... *G03G 21/12* (2013.01); *G03G 2221/0005* (2013.01); *G03G 21/0011* (2013.01); *G03G 21/10* (2013.01); *G03G 21/105* (2013.01); *G03G 2221/1624* (2013.01)
USPC ..... 399/358

(58) Field of Classification Search
CPC ..... G03G 21/00; G03G 21/10
USPC ..... 399/358
See application file for complete search history.

(56) References Cited

U.S. PATENT DOCUMENTS 4,630,653 A * 12/1986 Kan ..... 141/83
5,617,195 A * 4/1997 Torimaru et al. ..... 399/27
5,933,690 A * 8/1999 Sugimoto et al. ..... 399/257
6,055,405 A * 4/2000 Knott et al. ..... 399/358
6,937,838 B2 * 8/2005 Ishii et al. ..... 399/358
7,280,776 B2 * 10/2007 Cook et al. ..... 399/35
7,634,221 B2 * 12/2009 Kudo ..... 399/360
7,991,344 B2 * 8/2011 Naruse ..... 399/358
8,116,645 B2 * 2/2012 Yamaguchi et al. ..... 399/35
8,131,183 B2 * 3/2012 Ito ..... 399/120
8,135,293 B2 * 3/2012 Yamaguchi et al. ..... 399/35
8,346,151 B2 * 1/2013 Akaike et al. ..... 399/358
8,401,454 B2 * 3/2013 Pitas et al. ..... 399/358
2003/0108365 A1 * 6/2003 Kabai ..... 399/297
2004/0052560 A1 * 3/2004 Ishii et al. ..... 399/360
2005/0047807 A1 * 3/2005 Cook et al. ..... 399/35
2006/0120779 A1 * 6/2006 Uchihashi ..... 399/358
2007/0196147 A1 * 8/2007 Nada et al. ..... 399/358
2007/0264036 A1 * 11/2007 Craig et al. ..... 399/35
2009/0016793 A1 * 1/2009 Umehara et al. ..... 399/358
2009/0060603 A1 * 3/2009 Doi ..... 399/358
2010/0080580 A1 * 4/2010 Yamaguchi et al. ..... 399/35
2010/0080638 A1 * 4/2010 Ichikawa et al. ..... 399/358
(Continued)

FOREIGN PATENT DOCUMENTS

JP A-2006-162941 6/2006

*Primary Examiner* — Clayton E LaBalle
*Assistant Examiner* — Kevin Butler
(74) *Attorney, Agent, or Firm* — Muncy, Geissler, Olds & Lowe, P.C.

(57) ABSTRACT

An image forming apparatus includes a first developer containing part accommodating a developer that is ejected after a depeloper image is formed, a second developer containing part, a communication part allowing the first developer containing part and the second developer containing part to communicate each other, and a first developer carrying member carrying the developer to the first developer containing part to the communication part. Wherein, the communication part carries the developer carried by the first developer carrying member to the second developer containing part.

20 Claims, 16 Drawing Sheets

(56) References Cited

U.S. PATENT DOCUMENTS

| | | | | |
|---|---|---|---|---|
| 2010/0239340 | A1* | 9/2010 | Akaike et al. | 399/358 |
| 2010/0247192 | A1* | 9/2010 | Ishikawa et al. | 399/358 |
| 2011/0129249 | A1* | 6/2011 | Koshimura et al. | 399/99 |
| 2011/0158723 | A1* | 6/2011 | Yokokawa | 399/358 |
| 2012/0070209 | A1* | 3/2012 | Pitas et al. | 399/358 |
| 2012/0070210 | A1* | 3/2012 | Pitas et al. | 399/358 |
| 2012/0163837 | A1* | 6/2012 | Tomita et al. | 399/13 |
| 2012/0213568 | A1* | 8/2012 | Yamamoto et al. | 399/358 |
| 2013/0071165 | A1* | 3/2013 | Kitamura | 399/358 |
| 2013/0251433 | A1* | 9/2013 | Toshiyuki | 399/358 |
| 2013/0287412 | A1* | 10/2013 | Koga | 399/13 |
| 2014/0023414 | A1* | 1/2014 | Nishimura | 399/358 |
| 2014/0044465 | A1* | 2/2014 | Mekada | 399/358 |

* cited by examiner

DEVELOPER COLLECTION DEVICE AND IMAGE FORMING APPARATUS

CROSS REFERENCE TO RELATED APPLICATION

The present application is related to, claims priority from and incorporates by reference Japanese Patent Application No. 2011-204731, filed on Sep. 20, 2011.

TECHNICAL FIELD

The present invention relates to a developer collection device and an image forming apparatus which collects a developer such as waste developer.

BACKGROUND

As an image forming apparatus which uses a electrographic method, there is a type that uses, a direct transfer method directly transferring a toner image from a photosensitive body onto a medium and there is a type that uses, an intermediate transfer method transferring a toner image from a photosensitive body onto an intermediate transfer body and then transferring the toner image from the intermediate transfer body to a medium.

In both methods of the image forming apparatus, toner may remain on the surface of the photosensitive body and/or the intermediate transfer body after transfer of the toner image (may be referred to as "transfer remaining toner"). Therefore, collecting the toner remaining on the surface of the photosensitive body and/or the intermediate transfer body and accommodating the toner in a toner collection container, which is replaceable, is suggested (For example, see JP Laid-Open Patent Application No. 2006-162941 (FIG. 1 and FIG. 2)).

However, when an amount of the toner which is accommodated in the toner collection container has reached a regulated amount, a user has a burden to replace the toner collection container because the toner collection container no longer accommodates toner.

The present invention considers the above-described problem. One of objects of the present invention is to provide a developer collection device and image forming apparatus that reduces the burden for replacement.

SUMMARY

In a view of the present invention, an image forming apparatus disclosed in the application includes a first developer containing part accommodating a developer that is ejected after a depeloper image is formed, a second developer containing part, a communication part allowing the first developer containing part and the second developer containing part to communicate each other; and a first developer carrying member carrying the developer to the first developer containing part to the communication part. Wherein, the communication part carries the developer carried by the first developer carrying member to the second developer containing part.

In another view of the present invention, a developer collection device disclosed in the application includes an image carrier carrying a developer image on a surface thereof, a first developer containing part accommodating the developer, a developer collection mechanism carrying the developer to the first developer containing part, a developer carrying mechanism carrying the developer from the first developer containing part, and a second developer containing part accommodating the developer carried by the developer carrying mechanism and being removable from a device main body. Wherein the second developer containing part is provided in an internal region of the image carrier.

According to the present invention, the burden for replacing a developer containing part (first developer containing part) is reduced.

DETAILED DESCRIPTION OF EMBODIMENTS

First Embodiment

<Configuration>

Figure 1:
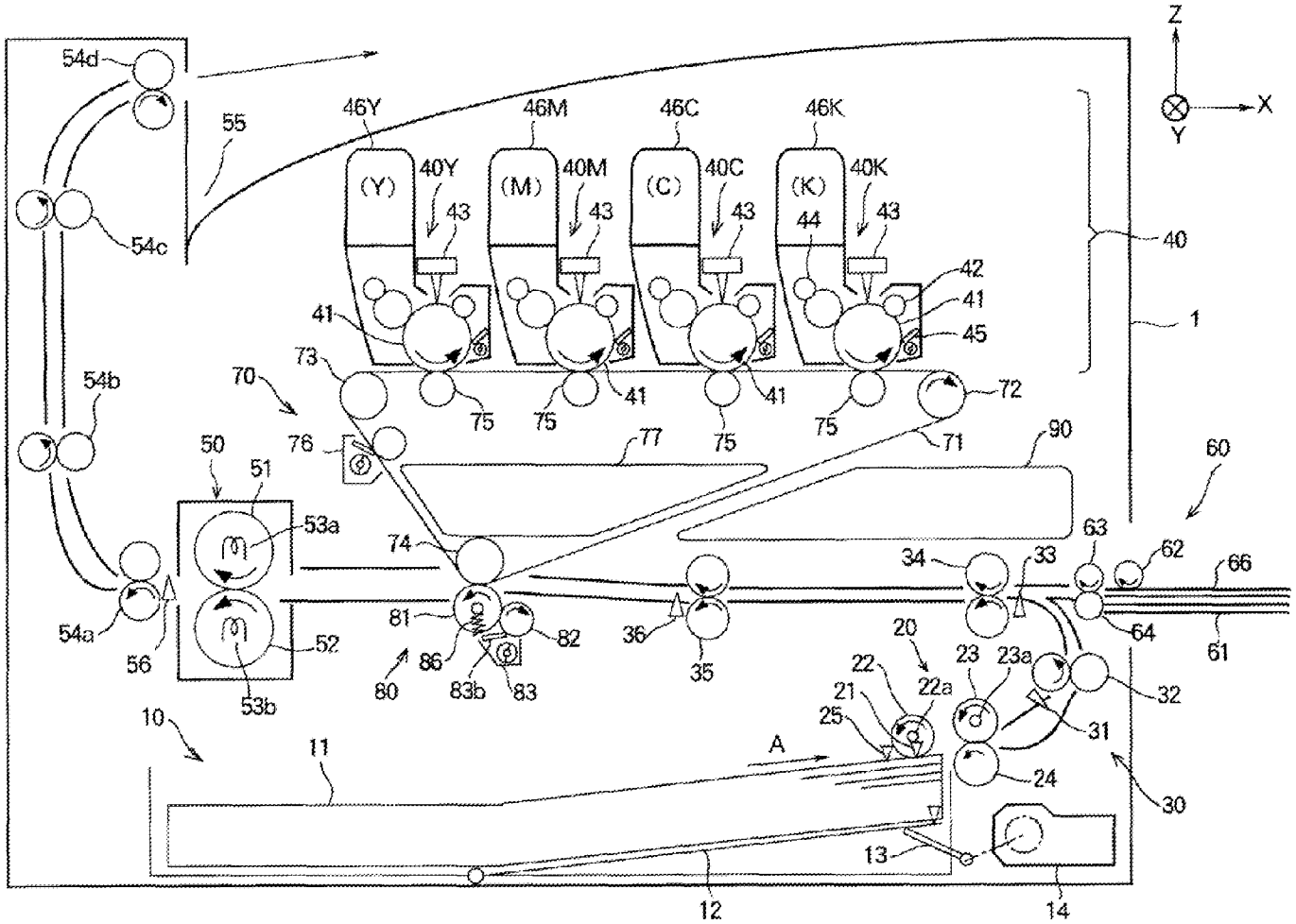
FIG. 1 is a diagram illustrating a basic configuration of an image forming apparatus in a first embodiment of the present invention.

FIG. 1 is a diagram illustrating a basic configuration of an image forming apparatus in a first embodiment of the present invention. The image forming apparatus includes a sheet tray (medium containing part) 10, in which sheets 11 as media are stacked, in a lower part of a main body 1 (hereinafter, referred to as a device main body) thereof. The sheet tray 10 is removably installed to the device main body 1. A sheet stacking plate 12 which is rotatably supported by a horizontal support shaft is provided in the sheet tray 10. The sheets 11 are stacked on the sheet stacking plate 12.

A swingably lift-up lever 13 is fixedly set up in a feeding side of the sheet tray 10. A swing shaft of the lift-up lever 13 is separably linked to a motor 14. The lift-up lever 13 is linked to the motor 14 as the sheet tray 10 is installed to the device main body 1. When the motor 14 rotates, the lift-up lever 13 swings and lifts the sheet stacking plate 12. Thereby, the sheets 11 are raised.

A pickup roller 22 is provided at a position where the pickup roller 22 contacts the upper surface of the sheets 11 when the sheet stacking plate 12 is raised. A raise detection part 21 is provided for detecting the sheets 11 which are raised to a height that the sheets 11 contact the pickup roller 22. A remaining amount sensor 25 which is adjacent to the raise detection part 21 is provided for detecting a remaining amount of the sheets 11 in the sheet tray 10.

A feed roller 23 and a retard roller 24 are adjacent to the right side of the pickup roller 22 in the figure, and are positioned to contact each other. The pickup roller 22 and the feed roller 23 are rotated in the arrow direction (counterclockwise direction in the figure) by a sheet supply motor 214 (FIG. 2), and feed the sheets 11 stacked on the sheet stacking plate 12 one by one in the right direction in the figure. The pickup roller 22 and the feed roller 23 include a one-way clutch mechanisms 22*a*, 23*a* respectively, and idle in the arrow direction even when the sheet supply motor 214 stops rotating. The retard roller 24 generates torque in the arrow direction by a torque generation device.

That is, the pickup roller 22 operates to feed the sheets 11 from the sheet tray 10. The feed roller 23 and the retard roller 24 operate to separate and feed each sheet 11 to a carrying path even if a plurality of the sheets 11 are simultaneously fed by the pickup roller 22. The pickup roller 22, feed roller 23 and retard roller 24 configure a medium feeding part 20.

A carrying roller pairs 32, 34, 35 which carry the sheet 11 are respectively positioned in a downstream side of the media feeding part 20 along the carrying path of the sheet 11 in a direction in which the sheet 11 is fed. The carrying roller pair 32 restricts skew of the sheet 11 which has passed the feed roller 23 and the retard roller 24, and carries the sheet 11. The carrying roller pairs 34, 35 carry the sheet 11 toward a later-described secondary transfer roller unit 80. Motive power is transmitted to the carrying roller pairs 32, 34, 35 from the above-mentioned sheet supply motor 214 via gears and the like. Thereby, the carrying roller pairs 32, 34, 35 rotate.

Sheet sensors 31, 33 are positioned adjacent to the upper stream side of the carrying roller pairs 32, 34 respectively, and detect the passing of the sheet 11. Respective timing of the rotation of the carrying rollers 32, 34 is decided based on detection signals of the sheet sensors 31, 33. A writing sensor 36 is positioned adjacent to the downstream side of the carrying roller pair 35, and detects the passing of the sheet 11. Timing for the writing (exposure by a print head 43) on a later-described image forming part 40 is decided based on a detection signal of the writing sensor 36.

A multi purpose tray (MPT) 60 is provided at the right side surface of the device main body 1 in the figure. The MPT 60 includes a sheet stacking plate 61, a pickup roller 62 which feeds a sheets 66 stacked on the sheet stacking plate 61, a sheet supply roller 63 which sends the fed sheets 66 toward the above-mentioned carrying roller pair 34, and a retard roller 64 that is pressed against the sheet supply roller 63 for separating the sheets 66 one by one.

An image forming part 40 includes four process units 40Y, 40M, 40C, 40K which respectively form yellow, magenta, cyan and black toner images (developer images). The process units 40Y, 40M, 40C, 40K are removably installed to the device main body 1, and are arranged in a line from the left to the right in the figure.

The process units 40Y, 40M, 40C, 40K include common configurations excepting toners to be used. Here, a configuration of the black process unit 40K will be explained.

The process unit 40K includes the photosensitive drum 41 as an electrostatic latent image carrier rotatable in the arrow direction (counterclockwise direction in the figure). A charge roller 42 as a charge member, a print head (exposure device) 43, a development roller 44 as a developer carrier, and a cleaning part 45 are fixedly set up in the periphery of the photosensitive drum 41. The charge roller 42 uniformly charges the surface of the photosensitive drum 41 along the rotation direction of the photosensitive drum 41. The print head (exposure device) 43 selectively irradiates light on the surface of the uniformly charged photosensitive drum 41 to form an electrostatic latent image. The development roller 44 develops the electrostatic latent image on the surface of the photosensitive drum 41 by toner (developer) to form a toner image. The cleaning part 45 removes toner which remains on the photosensitive drum 41 after the transfer of the toner image. The process unit 40K includes a toner containing part 46K which contains unused toner and provides the unused toner to the development roller 44.

Motive power is transmitted to the photosensitive drum 41 and each roller in each of the process units 40Y, 40M, 40C, 40K from motors 212Y, 212M, 212C, 212K as driving sources via gears and the like. Thereby, the photosensitive drum 41 and each roller in each of the process units 40Y, 40M, 40C, 40K rotate.

An intermediate transfer belt unit 70 is positioned in the lower side of the image forming part 40. The intermediate transfer belt unit 70 transfers the toner image, which is formed in each of the process units 40Y, 40M, 40C, 40K of the image forming part 40, onto an intermediate transfer belt 71, and transfers the toner image to the sheet 11 fed from the sheet tray 10 or the MPT 60 (here, sheet tray 10). The intermediate transfer belt unit 70 (replaceable unit) is configured to remove from the device main body 1.

The intermediate transfer belt unit 70 has an intermediate transfer belt 71 as an intermediate transfer body (image carrier) and transfer rollers (primary transfer rollers) 75 which are each positioned so as to face the photosensitive drum 41 of the corresponding process units 40Y, 40C, 40M, 40K across the intermediate transfer belt 71. The transfer roller 75 primarily transfers the toner image which is formed on the surface of each photosensitive drum 41 to the intermediate transfer belt 71. A later-described primary transfer voltage is applied to the transfer roller 75.

The intermediate transfer belt 71 is an endless belt and is strained by a driving roller 72 which is driven by a belt drive motor 213 (FIG. 2), a secondary transfer backup roller 74, and a tensioner roller 73 which applies tension to the intermediate transfer belt 71. The secondary transfer backup roller 74 is positioned so as to face a later-described secondary transfer roller 81, and transfers the toner image on the intermediate transfer belt 70 to the sheet 11. The driving roller 72, the secondary transfer backup roller 74, and the tensioner roller 73 are provided to the intermediate transfer belt unit 70.

The intermediate transfer belt unit 70 also includes a belt cleaning part 76 and a first waste toner containing part 77. The belt cleaning part 76 removes toner remaining on the surface of the intermediate transfer belt 71, and the first waste toner containing part 77 as a first developer containing part is provided in an internal region surrounded by the intermediate transfer belt unit 70.

The secondary transfer roller unit 80 as a secondary transfer part is fixedly set up in the lower side of the intermediate transfer belt unit 70. The secondary transfer roller unit 80 includes a secondary transfer roller 81 and a biasing member (for example, spring) 86. The secondary transfer roller 81 which is positioned so as to face the above-mentioned secondary transfer backup roller 74. The biasing member 86 which presses and biases the secondary transfer roller 81 to the secondary transfer backup roller 74. The secondary transfer roller 81 and the secondary transfer backup roller 74 are positioned in the carrying direction of the sheet 11 in the downstream side of the carrying roller pair 35. The sheet 11 which has passed the carrying roller pair 35 reaches a nip part of the secondary transfer roller 81 and the secondary transfer backup roller 74.

The secondary transfer roller unit 80 also includes a cleaner shaft 82 as a cleaning member and a secondary transfer cleaning part 83. The cleaner shaft 82 contacts the secondary transfer roller 81 to adhere the toner which is attached to the secondary transfer roller 81. The secondary transfer cleaning part 83 removes the toner which is adhered onto the cleaner shaft 82.

A fuser part 50 is positioned in the carrying direction of the sheet 11 in the downstream side (left side in the figure) of the secondary transfer roller unit 80. The fuser part 50 includes an upper roller 51 and a lower roller 52. The upper roller 51 contains a halogen lamp (heat source) 53*a* and includes an elastic member layer on the surface of the upper roller 51. The lower roller 52 contains a halogen lamp 53*b* and includes an elastic member layer on the surface of the lower roller 52. The fuser part 50 applies heat and pressure to the toner image on the sheet 11 sent from the secondary transfer roller unit 80, and melts the toner image to fix the toner image on the sheet 11.

Ejection roller pairs 54*a*, 54*b*, 54*c*, 54*d* and a stacker part 55 is fixedly set up in the carrying direction of the sheet 11 in the downstream side of the fuser part 50. The ejection roller pairs 54*a*, 54*b*, 54*c*, 54*d* eject the sheet 11 on which the toner image has been fixed. The stacker part 55 stacks the ejected sheets 11. Motive power is transmitted to the ejection roller pairs 54*a*, 54*b*, 54*c*, 54*d* from a carry motor 215 (FIG. 2) via gears and the like. Thereby, the ejection roller pairs 54*a*, 54*b*, 54*c*, 54*d* rotate. A sheet sensor 56 is fixedly set up in the downstream of the fuser part 50. Respective timing of the rotation of the ejection roller pairs 54*a*, 54*b*, 54*c*, 54*d* are decided based on a detection signal of the sheet sensor 56.

Figure 2:
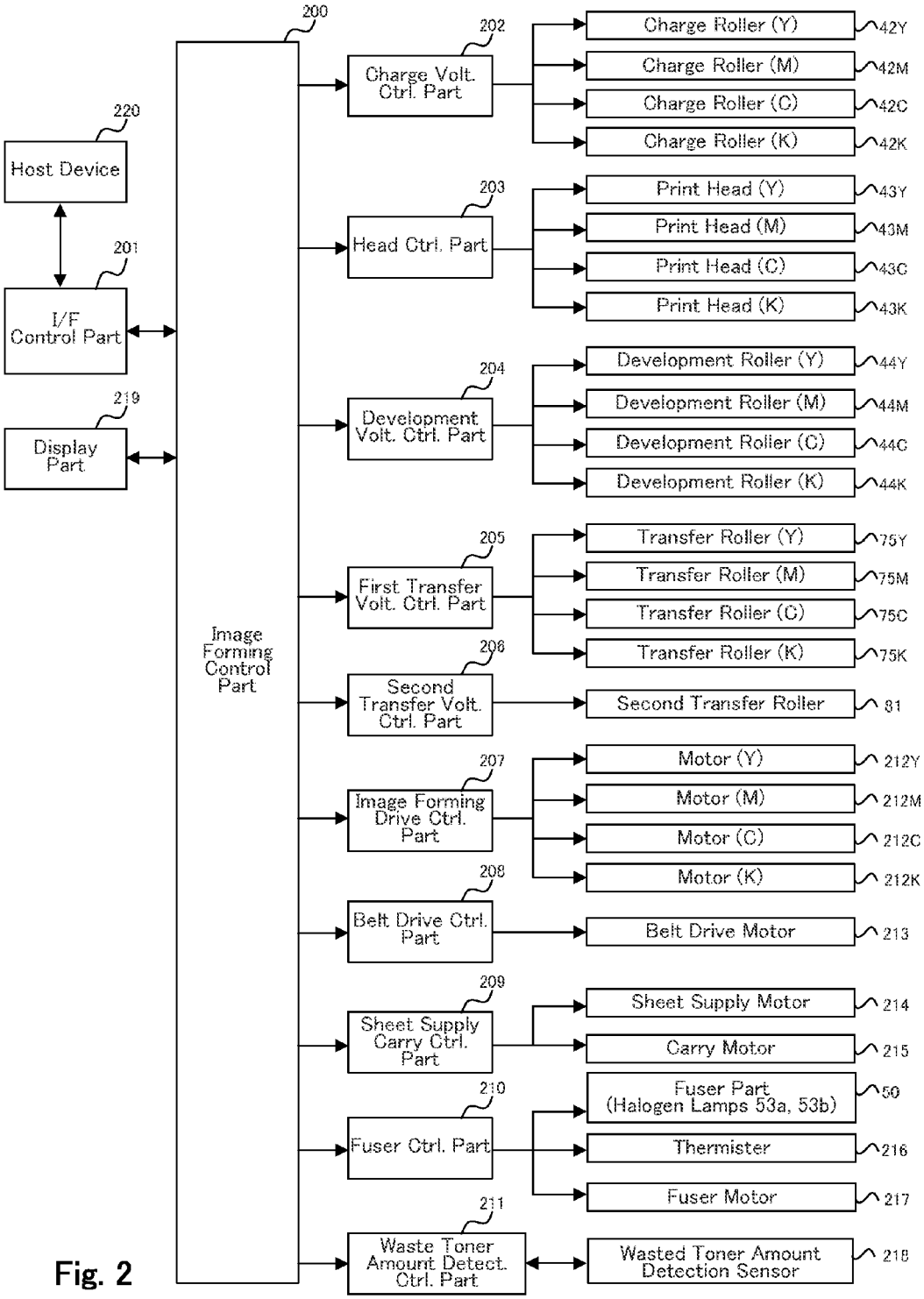
FIG. 2 is a block diagram illustrating a control system of the image forming apparatus in the first embodiment.

The image forming apparatus is a separate body from the intermediate transfer belt unit 70, and includes a second waste toner containing part 90 as a second developer containing part which is removable to the device main body 1. A waste toner amount detection sensor 218 (FIG. 2) as a developer amount detection part is provided in a second waste toner containing part 90. The waste toner amount detection sensor 218 detects a predetermined amount of the waste toner which is accommodated in the second waste toner containing part 90, and sends a detection signal to a later-described waste toner amount detection control part 211 (FIG. 2). The waste toner amount detection control part 211 displays an alarm on a display part 219 (FIG. 2) to suggest a user to replace the second waste toner containing part 90.

In FIG. 1, the vertical direction is defined as Z direction. The upper direction of Z direction is defined as +Z direction. The lower direction of Z direction is defined as −Z direction. In the XY surface which is orthogonal to Z direction, an arrangement direction of the process units 40Y, 40M, 40C, 40K is defined as X direction. A direction where the intermediate transfer belt 71 moves along the process units 40Y, 40M, 40C, 40K is defined as +X direction. The direction opposite from +X direction is defined as −X direction. A direction of a rotational shaft (a width direction of the intermediate transfer belt 71) of the photosensitive drum 41 in each process unit 40 is defined as Y direction. A direction going from the front edge of the sheet surface to the rear of FIG. 1 is defined as +Y direction. The direction opposite from +Y direction is defined as −Y direction.

FIG. 2 is a block diagram illustrating a control system of the image forming apparatus in the first embodiment. An image forming control part 200 which controls the image forming apparatus is configured with a microprocessor, a read-only memory (ROM), a random access memory (RAM), an input/output port, a timer and the like. The image forming control part 200 receives print data and a control command from a host device 220 such as a personal computer, and performs a sequence control of the image forming apparatus.

An interface (I/F) control part 201 sends information (printer information and the like) of the image forming apparatus to the host device 220, analyses a command sent from the host device 220, and processes the data sent from the host device 220.

A charge voltage control part 202 performs a control which charges a voltage to the charge roller 42 (42Y, 42M, 42C, 42K) based on an instruction from the image forming control part 200 to uniformly charge the surface of each photosensitive drum 41 of the process units 40Y, 40M, 40C, 40K.

A head control part 203 performs a control which drives the print head 43 (43Y, 43M, 43C, 43K) in accordance with the print data based on an instruction from the image forming control part 200 to expose the surface of each photosensitive drum 41 for forming an electrostatic latent image.

A development voltage control part 204 performs a control which applies a voltage to the development roller 44 (44Y, 44M, 44C, 44K) based on an instruction from the image forming control part 200 to develop the electrostatic latent image formed on the surface of each photosensitive drum 41.

A primary transfer voltage controller 205 performs a control which applies the primary transfer voltage to the transfer roller 75 (75Y, 75M, 75C, 75K) based on an instruction of the image forming control part 200 to primarily transfers the toner image formed on the surface of the photosensitive drum 41 to the intermediate transfer belt (image carrier) 71.

A secondary transfer voltage controller 206 performs a control which applies a secondary transfer voltage to the secondary transfer roller 81 based on an instruction of the image forming control part 200 to secondarily transfers the toner image to which is primary transferred to the intermediate transfer belt 71 to the sheet 11 (medium).

An image forming drive control part 207 performs a control which drives the motors 212Y, 212M, 212C, 212K based on an instruction of the image forming control part 200 to rotatably drive the photosensitive drum 41, the charge roller 42 and the development roller 44.

A belt drive control part 208 performs a control which drives the belt drive motor 213 based on an instruction of the image forming control part 200 to rotate the driving roller 72 for driving the intermediate transfer belt 71. When the driving roller 72 drives, the tensioner roller 73, the secondary transfer backup roller 74 and the secondary transfer roller 81 are driven to rotate.

A sheet supply carry control part 209 performs a control which drives the sheet supply motor 214, the carry motor 215 and the motor 14 based on an instruction of the image forming control part 200 to supply and carry the sheet 11. The sheet supply motor 214 rotatably drives the pickup roller 22, the feed roller 23, the carrying roller pairs 32, 34, 35. The carry motor 215 rotatably drives the ejection roller pairs 54*a*, 54*b*, 54*c*, 54*d*. The motor 14 (FIG. 1) drives the lift-up lever 13 for raising the sheet stacking plate 12 of the sheet cassette 10.

A detection temperature is input from a thermister 216 detecting a temperature of the fuser part 50 (FIG. 1) to the fuser control part 210. The fuser control part 21 controls to turn the halogen lamps 53*a*, 53*b* on and off. The halogen lamps 53*a*, 53*b* are heat sources of the fuser part 50. In addition, the fuser control part 210 performs a control which drives a fuser motor 217 to rotate the upper roller 51 of the fuser part 50 based on an instruction of the image forming control part 200. The lower roller 52 which contacts the upper roller 51 is driven to rotate following the upper roller 51.

A signal of the waste toner amount detection sensor 218 which detects an amount of the waste toner in the second waste toner containing part 90 is input to the waste toner amount controller 211. When the waste toner amount detection sensor 218 detects a predetermined amount of waste toner accumulated in the second waste toner containing part 90, the waste toner amount controller 211 displays an alarm on the display part 219 to suggest the user to replace the second waste toner containing part 90.

Figure 3:
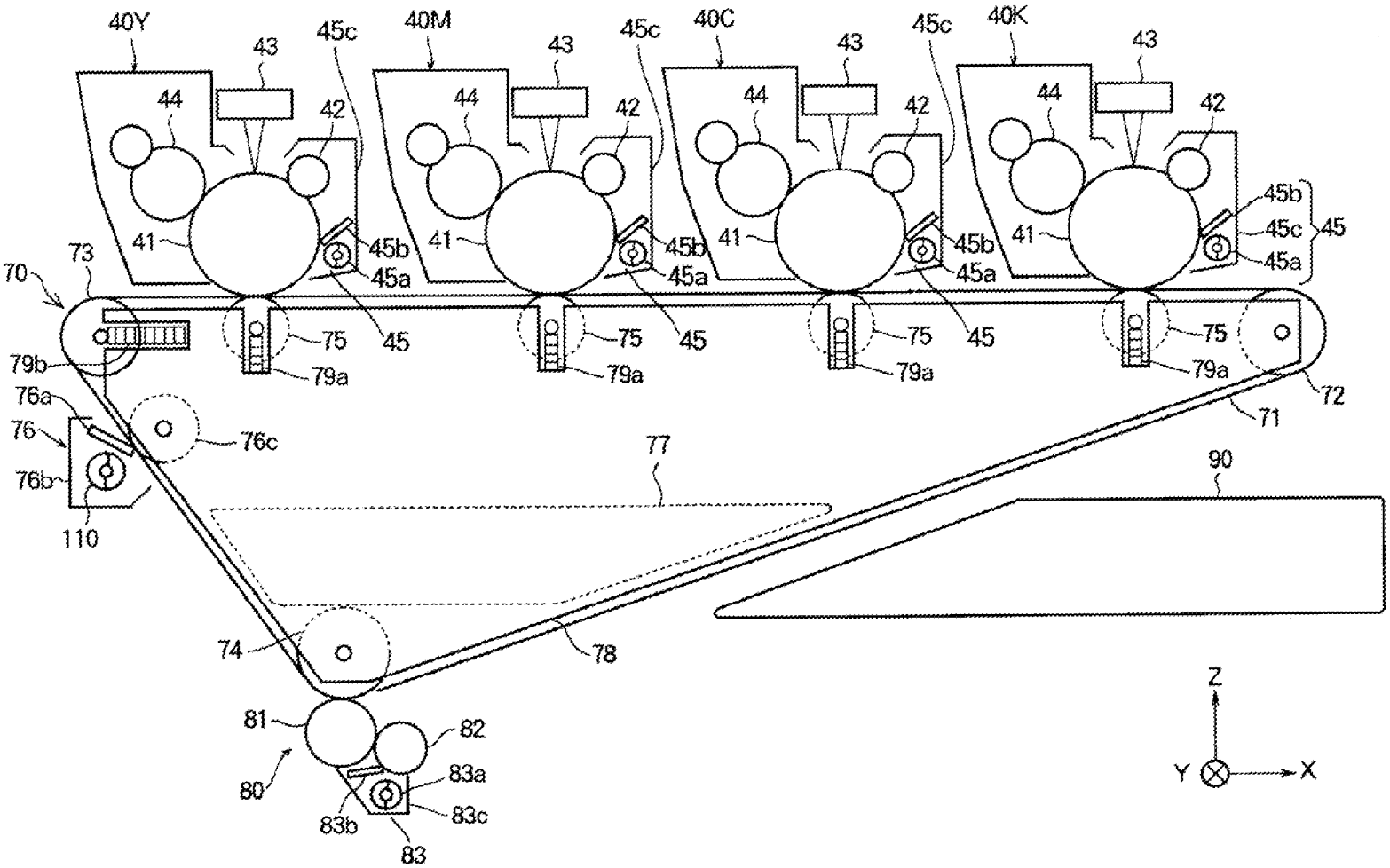
FIG. 3 is a side view illustrating an image forming part, an intermediate transfer belt unit, a secondary transfer roller unit and a second waste toner containing part in the first embodiment.

FIG. 3 is a side view illustrating the image forming part 40, the intermediate transfer belt unit 70, the secondary transfer roller unit 80 and the second waste toner containing part 90 in the first embodiment. The cleaning part 45 of each image forming part 40 (40Y, 40M, 40C, 40K) includes a drum cleaning blade 45*b*, a drum cleaner flame 45*c* and an auger 45*a* as a first developer collection member. The drum cleaning blade 45*b* scrapes the toner adhered on the photosensitive drum 41. The drum cleaner flame 45*c* retains the toner scraped. The auger 45*a* carries the waste toner retained in the drum cleaner flame 45*c* in a direction (specifically, +Y direction) parallel to the rotational shaft of the photosensitive drum 41.

The driving roller 72, tensioner roller 73 and secondary transfer backup roller 74 which strain the intermediate transfer belt 71 are supported by the belt frame 78 of the intermediate transfer belt unit 70. The first waste toner containing part 77 as the first developer containing part is formed in an internal region surrounded by the intermediate transfer belt 71 in the belt frame 78.

In addition, the second waste toner containing part 90 as the second developer containing part is fixedly set up in the device main body 1 so as to be adjacent to the first waste toner containing part 77 of the intermediate transfer belt unit 70 in the +X direction.

A belt cleaning part 76 of the intermediate transfer belt unit 70 includes a belt cleaning blade 76*a* as a cleaning member, a support shaft 76*c*, a belt cleaner frame 76*b*, and an auger 110 as a second developer collection member. The belt cleaning blade 76*a* scrapes the toner adhered on the surface of the intermediate transfer belt 71. The support shaft 76*c* faces the belt cleaning blade 76*a* across the intermediate transfer belt 71. The belt cleaner frame 76*b* retains the waste toner scraped by the belt cleaning blade 76*a*. The auger 110 carries the waste toner accumulated in the belt cleaner frame 76*b* in the +Y direction.

The secondary transfer cleaning part 83 of the secondary transfer roller unit 80 includes a secondary transfer cleaning blade 83*b* as the cleaning member, a secondary transfer cleaner frame 83*c*, and an auger 83*a* as a third developer collection member. The secondary transfer cleaning blade 83*b* scrapes the waste toner absorbed to the cleaner shaft 82. The secondary transfer cleaner frame 83*c* retains the scraped waste toner. The auger 83*a* carries the waste toner accumulated in the secondary transfer cleaner frame 83*c* in the +Y direction.

Figure 4:
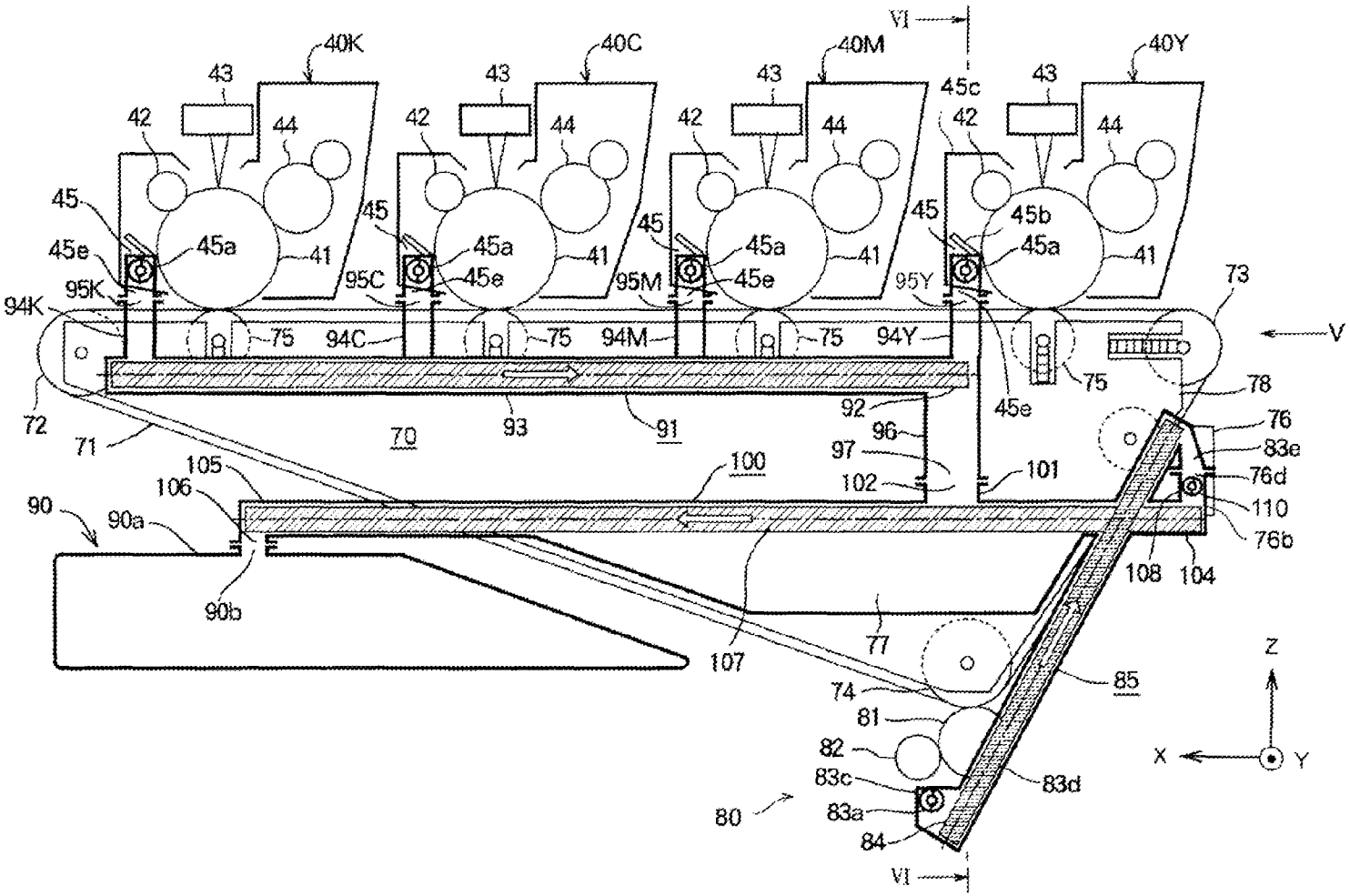
FIG. 4 is a side view of the image forming part, the intermediate transfer belt unit, the secondary transfer roller unit and the second waste toner containing part in the first embodiment viewed from an opposite side of FIG. 3.
Figure 5:
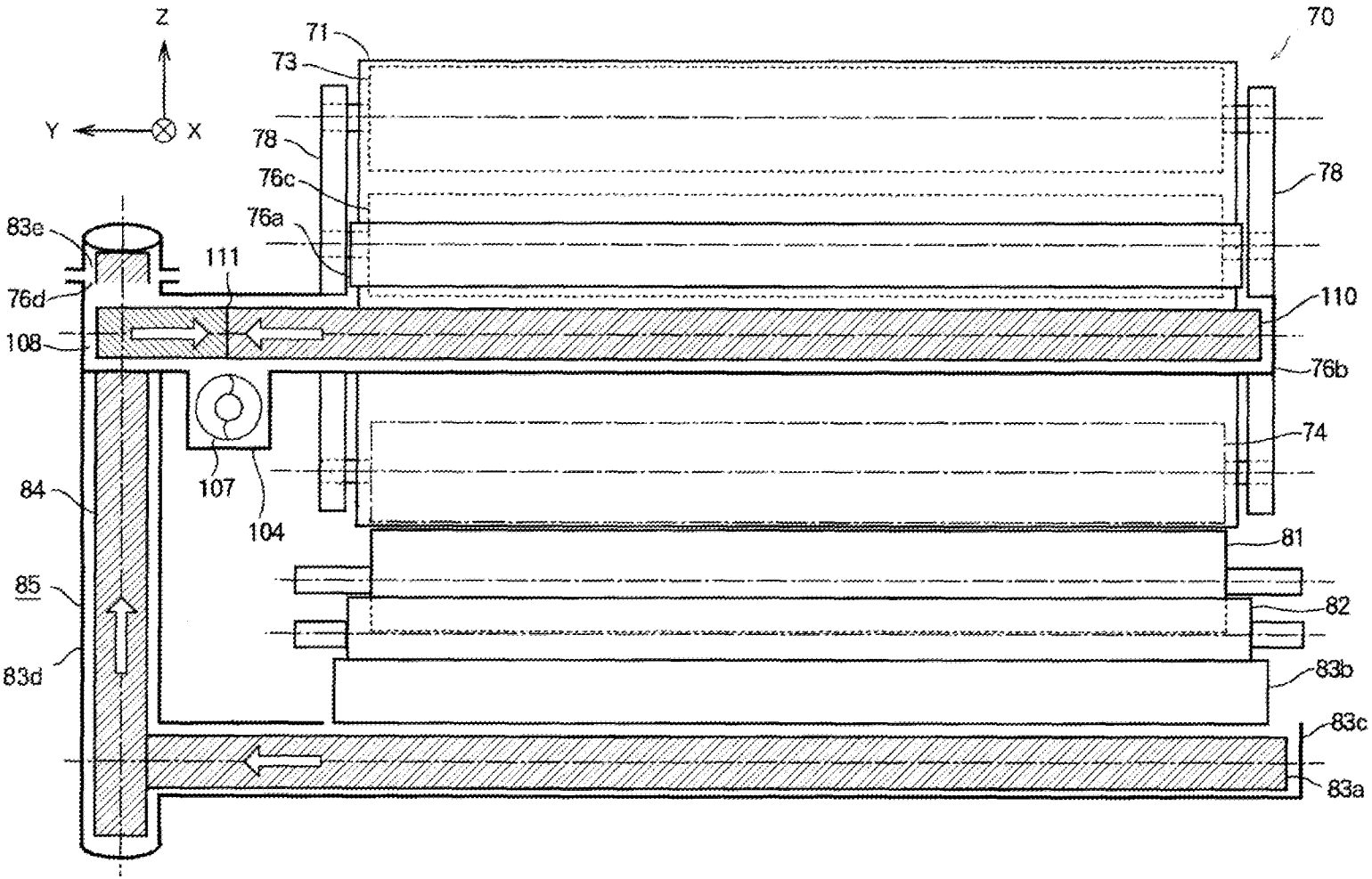
FIG. 5 is a rear view of the image forming part, the intermediate transfer belt unit, the secondary transfer roller unit and the second waste toner containing part in the first embodiment viewed from a direction of an arrow V shown in FIG. 4.

FIG. 4 is a side view of the image forming part 40, the intermediate transfer belt unit 70, the secondary transfer roller unit 80 and the second waste toner containing part 90, in the first embodiment viewed from an opposite side of FIG. 3. FIG. 4 also shows a collection path of the waste toner. FIG. 5 is a rear view of the image forming part 40, the intermediate transfer belt unit 70, the secondary transfer roller unit 80 and the second waste toner containing part 90 viewed from a direction of arrow V shown in FIG. 4 and partially illustrating in cross-sections.

An opening part 45*e* which opens in the lower direction is formed in the drum cleaner flame 45*c* of each of the process units 40Y, 40M, 40C, 40K. A waste toner carrying duct 91 as a second developer carrying part is fixedly set up in the lower side of each of the process units 40Y, 40M, 40C, 40K.

The waste toner carrying duct 91 includes four duct parts (first communication parts) 94Y, 94M, 94C, 94K and a duct part (second communication part) 93. The duct parts (first communication parts) 94Y, 94M, 94C, 94K have respective opening parts 95Y, 95M, 95C, 95K facing each opening part 45*e* and extends in the Z direction. The duct part (second communication part) 93 communicates to the duct parts 94Y, 94M, 94C, 94K and extends in the X direction. An auger 92 as a second developer carrying member is provided in the duct part 93, and carries the waste toner fallen from the duct parts 94Y, 94M, 94C, 94K in the −X direction. In addition, a duct part (third communication part) 96 is provided that communicates to an edge part (end edge) of the duct part 93 of the −X direction and that extends in the Z direction. The duct part 96 has an opening part 97 which opens in the lower direction.

A waste toner carrying duct 100 as a first developer carrying part is installed to the belt frame 78 of the intermediate transfer belt unit 70. The waste toner carrying duct 100 has a duct part (fourth communication part) 101 and the first waste toner containing part 77 as the first developer containing part. The duct part (fourth communication part) 101 includes an opening part 102 facing the opening part 97 of the duct 96. The first waste toner containing part 77 communicates to the duct part 101. Here, the first waste toner containing part 77 has a length from the process unit 40Y to the process unit 40C.

The waste toner carrying duct 100 includes a duct part (fifth communication part) 104 and a duct part 105 as a communication part (or sixth communication part). The duct part (fifth communication part) 104 extends in the −X direction from the upper part of the first waste toner containing part 77. The duct part 105 extends in the +X direction from the upper part of the first waste toner containing part 77 to the second waste toner containing part 90. In addition, the waste toner carrying duct 100 includes an auger 107 as a developer carrying member (or first developer carrying member) carrying the waste toner from the duct part 104 to the duct part 105 via the first waste toner containing part 77.

The above-mentioned belt cleaner frame 76*b* (see FIG. 5) communicates in the Y direction on the edge of the −X direction of the duct part 104 via a duct part 108 (seventh communication part). The above-mentioned auger 110 which carries the waste toner in the +Y direction is included in of the belt cleaner frame 76*b*. That is, the belt cleaner frame 76*b* communicates with the duct part 104 in the vicinity of the edge part of the downstream side of the carrying direction (+Y direction) where the auger 110 carries the waste toner. An opening part 76*d* which opens in the upper direction is formed on the edge of the +Y direction (that is, the vicinity of the end edge of the auger 110) of the belt cleaner frame 76*b*.

The duct part 105 is provided so as to communicate in the toner carrying direction (+X direction) where the auger 107 carries the toner to the downstream side of the first waste toner containing part 77. The auger 107 extends through the first waste toner containing part 77 and into the duct part 105. Thereby, the waste toner carrying duct 100 carries the waste toner to the first waste toner containing part 77 as the first developer containing part.

The secondary transfer roller cleaning part 83 includes a duct part (eighth communication part) 83*d* and an auger (third developer carrying member) 84. The duct part (eighth communication part) 83*d* communicates to the above-mentioned secondary transfer cleaner frame 83*c*, and extends in the upper direction. The auger 84 is provided in the duct 83*d*, and carries the waste toner in the upper direction. The duct part 83*d* has an opening part 83*e* facing the opening part 76*d* to carry the waste toner carried by the auger 84 to the belt cleaning part 76. The secondary transfer cleaner frame 83*c*, the duct part 83*d*, the auger 83*a* and the auger 84 configure a waste toner carrying duct 85 as third developer carrying part.

As shown in FIG. 5, the opening part 76*d* of the above-mentioned belt cleaner frame 76*b* is formed at a position corresponding to the opening part 83*e* of the secondary transfer roller cleaning part 83. The auger 110, which is provided in the belt cleaner frame 76*b*, is configured so that the carrying direction of the waste toner is opposite based on a position indicated by reference number 111, that is, a position connected to the duct 104. Thereby, the auger 110 collects and carries the waste toner collected and carried from the belt cleaning part 76 and the secondary transfer roller cleaning part 83 to the duct 104.

As shown in FIG. 4, the second waste toner containing part 90, as the second developer containing part is fixedly set up in the downstream side of the first waste toner containing part 77 in the carrying direction in which the auger 107 carries the waste toner. The second waste toner containing part 90 includes a waste toner collection frame 90*a* having a space accommodating the waste toner in the waste toner collection frame 90*a*. An opening part 90*b* which faces an opening part 106 opening in the lower direction of the duct part 105 is formed in the waste toner collection frame 90*a*.

Figure 6:
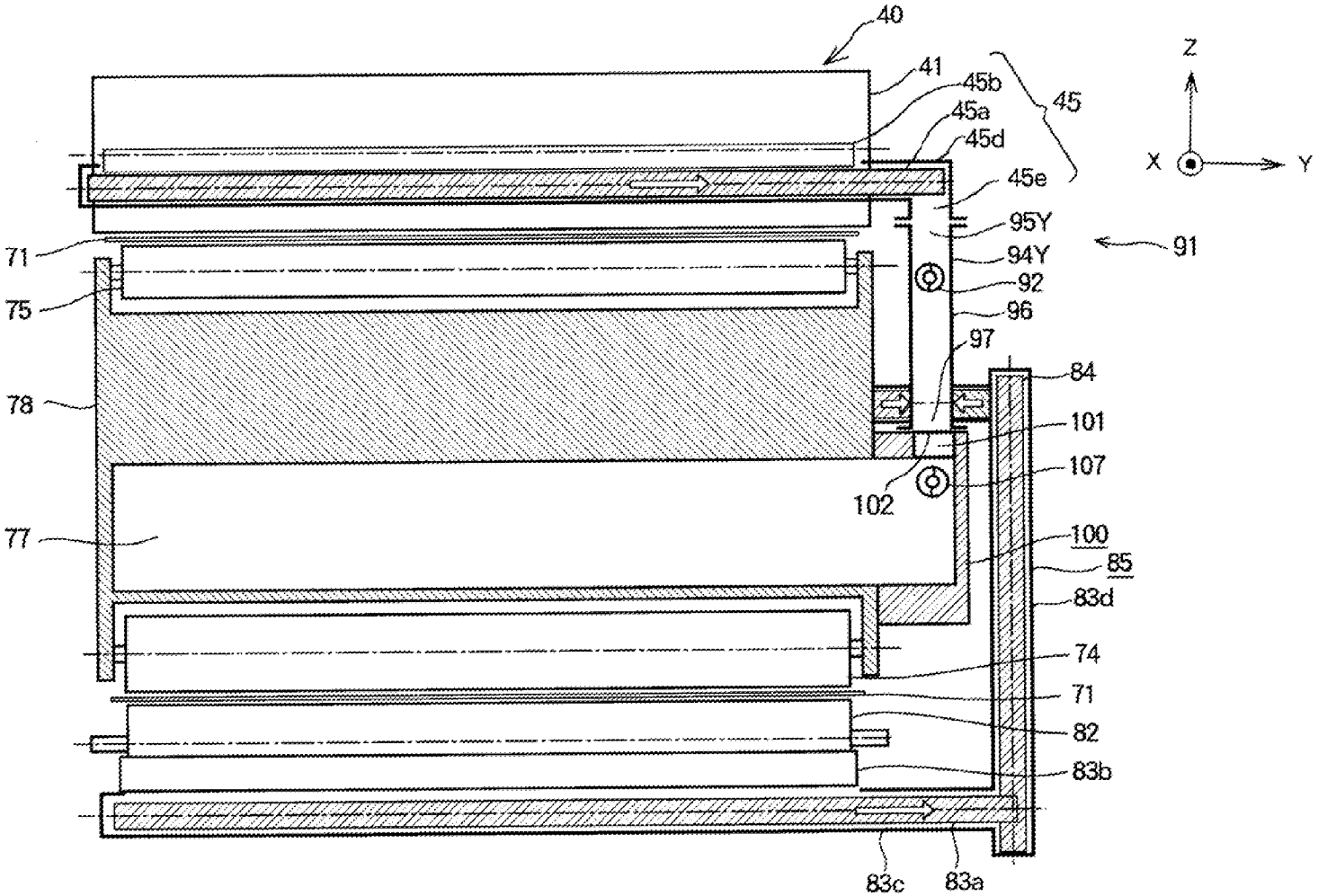
FIG. 6 is a cross-sectional view along a line VI-VI in FIG. 4 in a direction viewed from an arrow illustrating the image forming part, the intermediate transfer belt unit, the secondary transfer roller unit and the second waste toner containing part in the first embodiment.

FIG. 6 is a cross-sectional view along a line VI-VI in FIG. 4 in a direction viewed from an arrow. An opening part 95Y which opens in the upper direction of a duct part 94Y of the waste toner carrying duct 91 faces the opening part 45*e* opening in the lower direction of the drum cleaner flame 45*c*. The opening part 97 which opens in the lower direction of the duct part 96 of the waste toner carrying duct 91 faces the opening part 102 opening in the upper direction of the duct part 101 of the waste toner carrying duct 100 installed to the belt frame 78. The waste toner carrying duct 91 is attached to the device main body 1 as mentioned above.

It is obvious from FIG. 6 that a size of the first waste toner containing part 77 and a size of the second waste toner containing part 90 in the Y direction are larger than a width of the intermediate transfer belt 71. In addition, the augers 84, 92, 107 and the duct parts 83*d*, 93, 96, 101, 104, 105 are positioned outside of the intermediate transfer belt 71 in the +Y direction. Thereby, for example, the waste toner is carried from the first waste toner containing part 77 fixedly set up in the intermediate transfer belt 71 via the duct part 105 in the second waste toner containing part 90 fixedly set up outside of the intermediate transfer belt 71.

Figure 7:
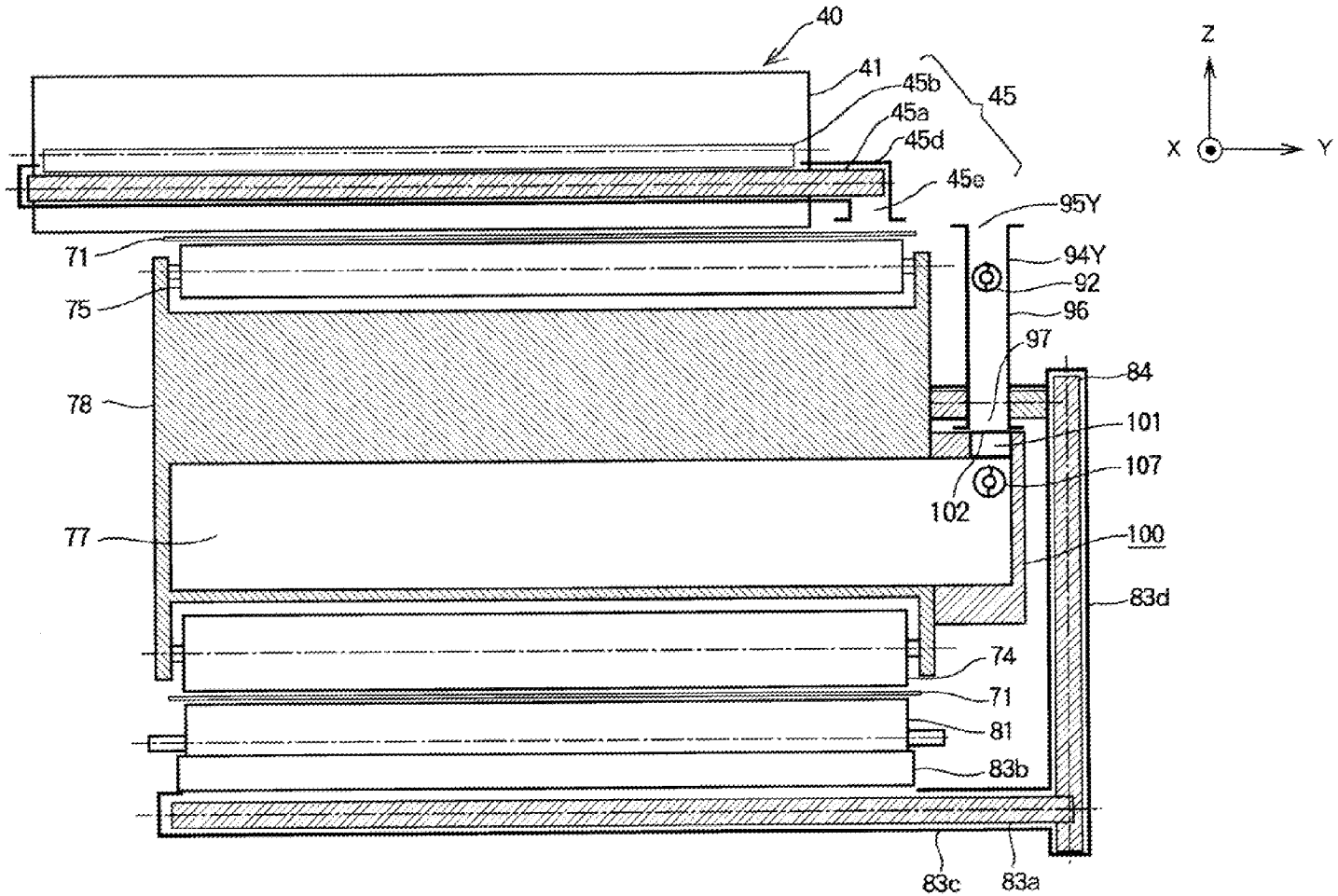
FIG. 7 is a cross-sectional view illustrating a state of the image forming part and a device main body when the image forming part is removed from the device main body in the first embodiment.

FIG. 7 is a view illustrating a state of the image forming part and a device main body when the image forming part is removed from a device main body in the first embodiment. FIG. 7 corresponds to the cross-sectional view along the line VI-VI in FIG. 4 in the direction viewed from the arrow. The image forming part 40 is configured so as to be removably from the device main body 1 in the Y direction by a support member (not shown). When the image forming part 40 is removed from the device main body 1 in the −Y direction, joints of the opening parts 45*e* of the drum cleaner flames 45*c* and joints of the opening parts 95Y, 95M, 95C, 95K of the waste toner carrying duct 91 installed to the device main body 1 are separated.

Figure 8:
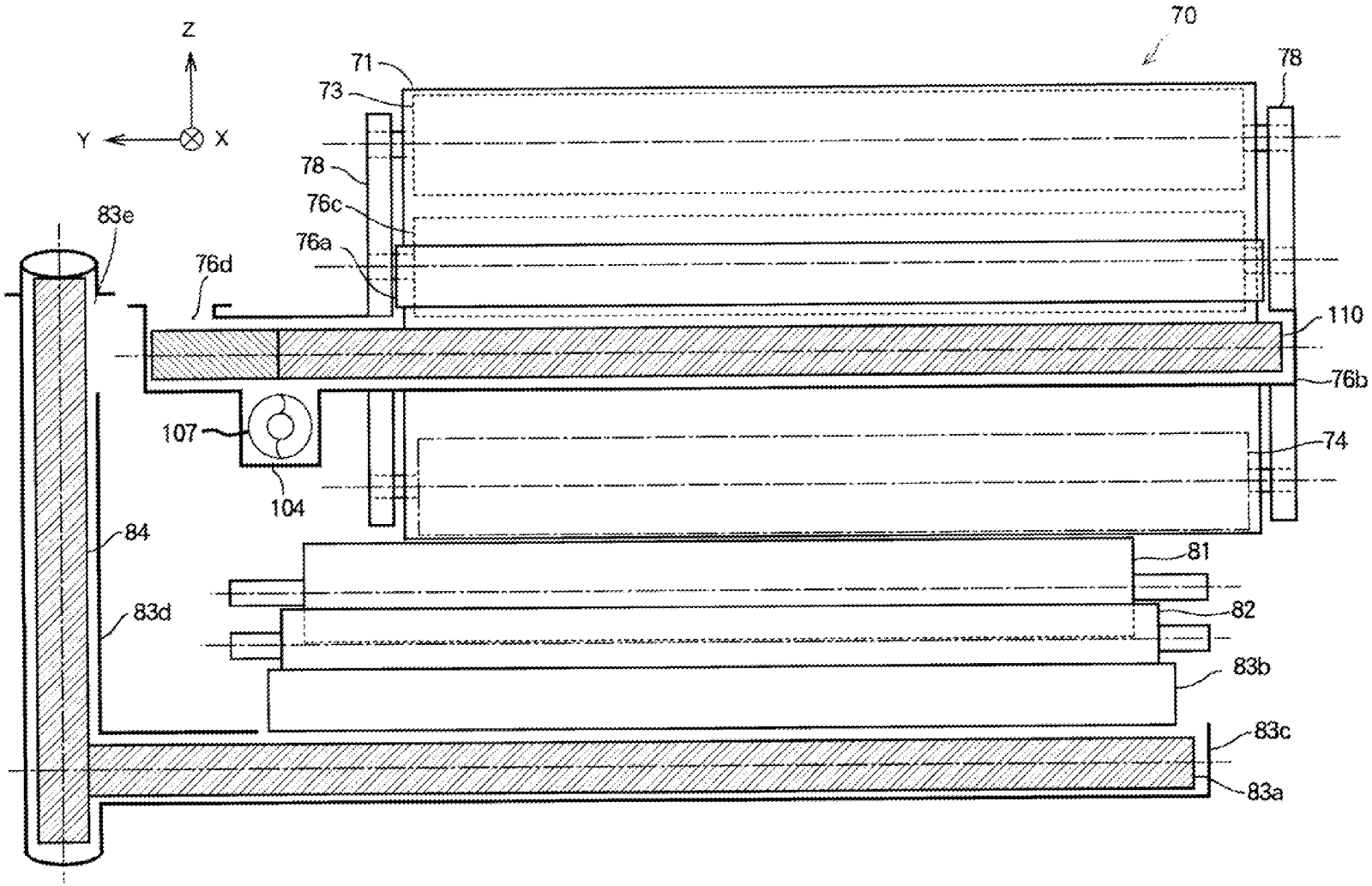
FIG. 8 is a rear view illustrating a state of the intermediate transfer belt and the device main body when the intermediate transfer belt is removed from the device main body in the first embodiment.
Figure 9:
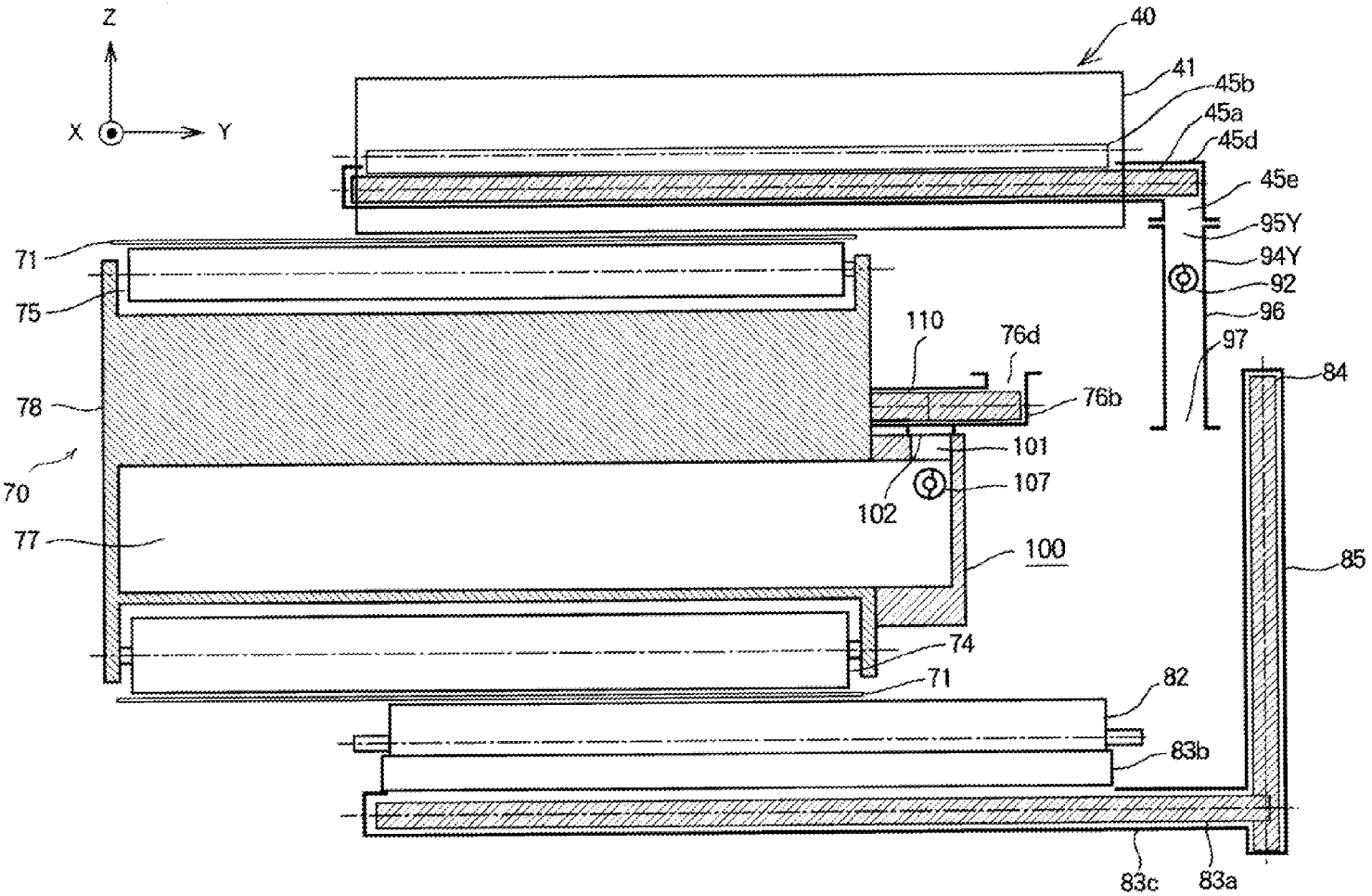
FIG. 9 is a cross-sectional view illustrating a state of the intermediate transfer belt and the device main body when the intermediate transfer belt is removed from the device main body in the first embodiment.

FIG. 8 and FIG. 9 are views illustrating states of the intermediate transfer belt 70 and the device main body 1 when the intermediate transfer belt 70 is removed from the device main body 1. FIG. 8 corresponds to the view viewed from the direction of arrow V shown in FIG. 4. FIG. 9 corresponds to the cross-sectional view along the line VI-VI in FIG. 4 in the direction viewed from the arrow. The intermediate transfer belt unit 70 is configured so as to remove from the device main body 1 in the Y direction by a support member (not shown).

As shown in FIG. 8, when the intermediate transfer belt unit 70 is removed from the device main body 1 in the −Y direction, a joint of the opening part 76*d* of the belt cleaner frame 76*b* of the belt cleaning part 76 and a joint of the opening part 83*e* of the secondary transfer cleaner frame 83*a* of the secondary transfer roller cleaning part 83 are separated. In addition, as shown in FIG. 9, a joint of the opening part 102 of the duct part 101 of the waste toner carrying duct 100 and a joint of the opening part 97 of the duct part 96 of the waste toner carrying duct 91 are separated.

In the above-mentioned configuration, the toner collection device is configured with the intermediate transfer belt unit 70 (replaceable unit) including the first waste toner containing part 77 (first developer containing part) and the second waste toner containing part 90 (second developer containing part) fixedly set up to the device main body 1. In addition, the developer carrying mechanism is configured with the auger 107 and the duct part 105. The mechanism carries the toner from the first waste toner containing part 77 to the second waste toner containing part 90.

The waste toner carrying duct 100, which includes the first waste toner containing part 77, is fixedly set up in the intermediate transfer belt unit 70, which is a consumable item which is replaced more often than the device main body 1, that is, a consumable item having a short replacement cycle. In addition, the second waste toner containing part 90 is fixedly set up in the device main body 1 (second unit), which is replaced less often than the intermediate transfer belt unit 70, that is, which has a long replacement cycle. In addition, the waste toner carrying duct 91 (second developer carrying part) and the waste toner carrying duct 85 (third developer carrying part) is positioned in the device main body 1 side.

The above-mentioned augers 45*a*, 84, 92, 107, 110 are configured with a spiral member including a spiral rib, or a coil spring, for example. The augers 45*a*, 84, 92, 107, 110 receive motive power transmission from the driving roller 72 via gears or helical gears and the like, rotate, and generate carrying forces in predetermined carrying direction respectively.

<Operation>

Next, basic operations of the image forming apparatus in the present embodiment will be explained with reference to FIG. 1 and FIG. 2. The image forming control part 200 (FIG. 2) of the image forming apparatus receives a print instruction and print data from the host device 220, and starts an image forming operation. The sheet supply motor 214 is firstly driven by the sheet supply carry control part 209. The pickup roller 22 rotates and the sheets 11 are fed from the sheet cassette 10. The fed sheets 11 are separated one by one by the feed roller 23 and the retard roller 24. Moreover, each sheet 11 is carried by the carrying roller pairs 32, 34, 35. In addition, the sheet 11 moves to the nip part of the secondary transfer roller 81 of the secondary transfer roller unit 80 and the secondary transfer backup roller 74.

A charge voltage is applied to the charge roller 42 by the charge voltage control part 202. The charge roller 42 uniformly charges the surface of the photosensitive drum 41 in each of the process units 40Y, 40M, 40C, 40K. The print head 43 is driven by the head control part 203, exposes the surface of the photosensitive drum 41 in accordance with image information, and forms an electrostatic latent image. A development voltage is applied to the development roller 44 by the development voltage control part 204. The development roller 44 develops the electrostatic latent image on the surface of the photosensitive drum 41 by toner, and forms a toner image.

A primary transfer voltage is applied to each transfer roller 75 of the intermediate transfer belt unit 70 by the primary transfer voltage control part 205. The toner image of the surface of the photosensitive drum 41 of each process unit 40Y, 40M, 40C, 40K is transferred to the intermediate transfer belt 71. In addition, the secondary transfer voltage is applied to the secondary transfer roller 81 of the secondary transfer roller unit 80 by the secondary transfer voltage control part 206. The toner image on the surface of the intermediate transfer belt 71 is transferred to the sheet 11 passing the nip part of the secondary transfer roller 81 and the secondary transfer backup roller 74.

The sheet 11 on which the toner image is transferred at the secondary transfer roller unit 80 is carried to the fuser part 50. Heat and pressure are added to the toner image on the sheet 11 in the fuser part 50, and the toner image is fixed on the sheet 11. The sheet 11 on which the toner image has been fixed is ejected on the stacker part 55 by the ejection roller pairs 54*a*, 54*b*, 54*c*, 54*d*. Thereby, image forming onto the sheet 11 is completed. The image forming onto the sheet 66 of the MPT 60 is performed in the same manner.

Figure 10:
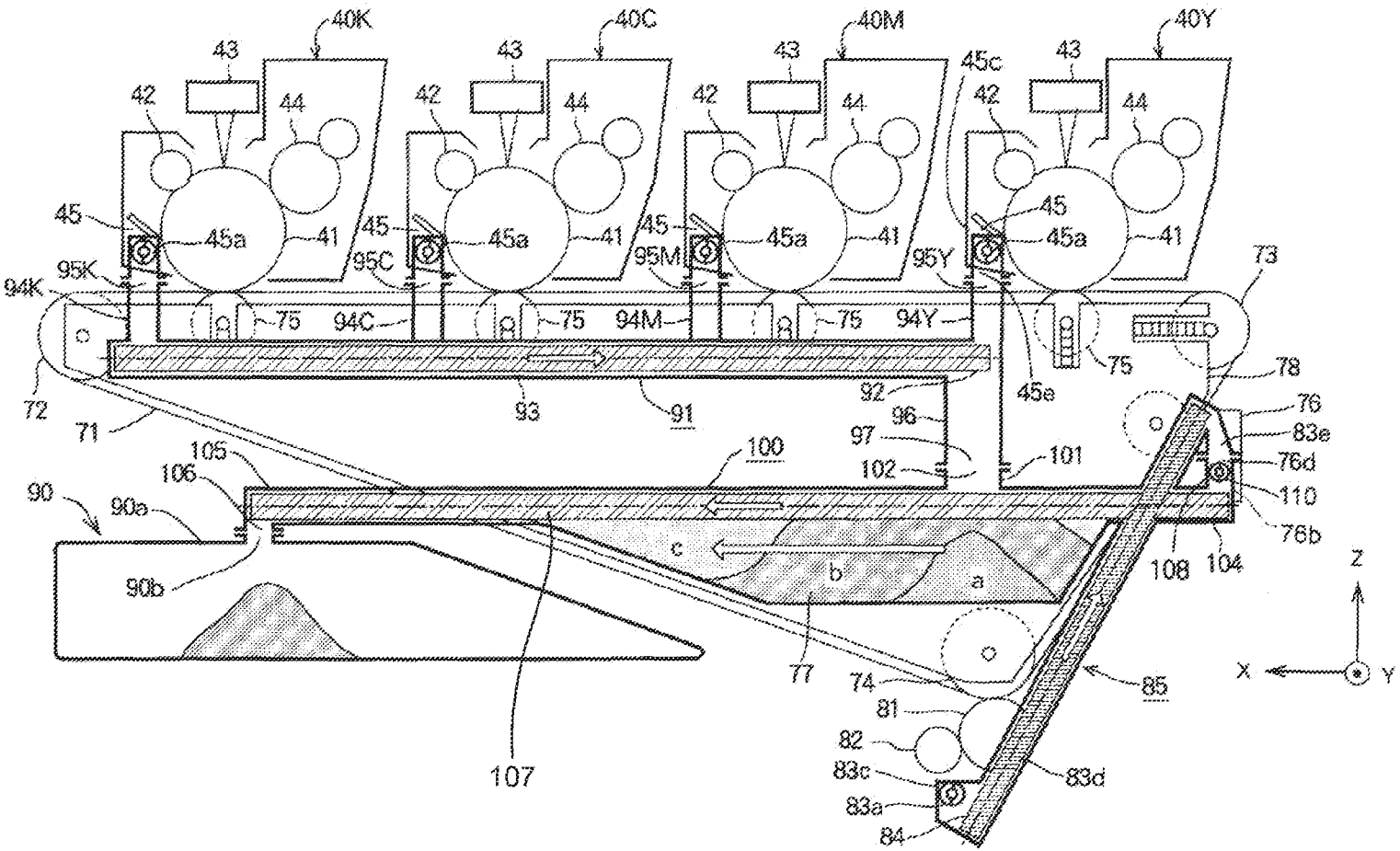
FIG. 10 is a diagram illustrating collection operations of waste toner in the first embodiment.

Next, collection operations of the waste toner in the present embodiment will be explained. FIG. 10 is a diagram illustrating collection operations of waste toner in the present embodiment.

In FIG. 10, the waste toner which has been generated in the process units 40Y, 40M, 40C, 40K of the image forming part 40 is carried in the +Y direction by the auger 45*a* of each drum cleaning part 45. The waste toner passes through the opening parts 95Y, 95M, 95C, 95K of the waste toner carrying duct 91 from the opening part 45*e*, falls into the duct parts 94Y, 94M, 94C, 94K, and reaches the duct part 93. The waste toner which has reached the duct part 93 is carried in the −X direction (right direction in the figure) by the auger 92. The waste toner falls from the end edge of the duct part 93 into the duct part 96. The waste toner reaches the duct part 101 of the waste toner carrying duct 100.

Meanwhile, the waste toner, which has been generated in the belt cleaning part 76, is carried in the +Y direction by the auger 110. The waste toner reaches the duct part 104 of the waste toner carrying duct 100.

In addition, after the waste toner, which has been generated in the secondary transfer cleaning part 83, is carried in the +Y direction by the auger 83*a*, the waste toner is carried in the upper direction by the auger 84, and is sent from the opening part 83*e* to the duct part 104.

The waste toner sent to the duct part 104 (the waste toner which has been generated in the belt cleaning part 76 and the secondary transfer cleaning part 83) is carried in the +X direction by the auger 107. The waste toner is accommodated in the first waste toner containing part 77 in the belt frame 78 together with the waste toner sent from the duct part 101 (waste toner which has been generated in the image forming part 40).

The waste toner which has been accommodated in the first waste toner containing part 77 is firstly accumulated as indicated by the reference number a in FIG. 10. When an accumulation amount of the waste toner increases and reaches a height at the auger 107 as indicated in reference number b, the waste toner starts to be carried in the +X direction (duct part 105 side) by the auger 107. When the accumulation amount of the waste toner further increases, the first waste toner containing part 77 is almost filled with the waste toner as indicated in reference number c. However, the waste toner is carried to the duct part 105 by the auger 107. The waste toner is sent from the opening part 106 to, and is accommodated in the second waste toner containing part 90.

When the image forming apparatus further continues an operation, the waste toner is accommodated in the second waste toner containing part 90. When an amount of the waste toner in the second waste toner containing part 90 reaches a predetermined amount, the waste toner amount detection sensor 218 (FIG. 2) detects the predetermined amount, and the waste toner amount detection control part 211 displays an alarm on the display part 219 (FIG. 2), and suggests a user to replace the second waste toner containing part 90.

The replacement cycle of the intermediate transfer belt unit 70 is preliminarily determined, for example, in consideration of durability and the like of the intermediate transfer belt 71. Accordingly, the intermediate transfer belt unit 70 is replaced independently of the accumulation amount of the waste toner in the first waste toner containing part 77. Here, a volume of the first waste toner containing part 77 is preferably determined so that the waste toner in the first waste toner containing part 77 is carried to the second waste toner containing part 90 before the intermediate transfer belt unit 70 reaches the replacement time period. Thereby, the intermediate transfer belt unit 70 is replaced at the replacement time of the intermediate transfer belt unit 70 when the toner amount of the first waste toner containing part 77 reaches a state that the first waste toner containing part 77 is filled with the waste toner. Accordingly, the volume of the first waste toner containing part 77 is suppressed to the minimum necessary volume and a space which the first waste toner containing part 77 occupies is decreased.

That is, the replacement cycle of the intermediate transfer belt unit 70 is defined as L1. An average replacement number of the intermediate transfer belt unit 70 in a life L2 of the image forming apparatus is defined as N. A maximum value of the generation amount of the waste toner in the replacement cycle L1 experimentally obtained is defined as BMax. An accommodation amount B1 of the first waste toner containing part 77 is preferably smaller than BMax ($B1<BMax$).

In addition, an accommodation amount B2 of the second waste toner containing part 90 is preferably $B2\geq(BMax-B1)\times N$ with respect to the accommodation amount B1 of the first waste toner containing part 77. By setting as mentioned above, the second waste toner containing part 90 advantageously need not to be replaced until the image forming apparatus reaches the life L2.

The predetermined amount of the waste toner which is accommodated in the first waste toner containing part 77 is decided by the height and the like of the duct part 105. When the volume of the first waste toner containing part 77 (possible accommodation amount of the waste toner) is defined as 100%, the volume is preferably set within a range from 75% to 100%. In the embodiment, the volume is defined as 100%.

<Effects>

As mentioned above, in the first embodiment, while a plurality of the waste toner containing parts 77, 90 are provided, one of them (first waste toner containing part 77) is fixedly set up in the replaceable intermediate transfer belt unit 70, and the waste toner is carried to and is accommodated in the second waste toner containing part 90 by the auger 107 provided in the first waste toner containing part 77. By configuring mentioned above, while a sufficient accommodation amount of the waste toner is secured, burdens for the frequent replacements of the waste toner containing part are reduced.

In addition, the first waste toner containing part 77 which is provided in the intermediate transfer belt unit 70 as a consumable item is configured so as to firstly accommodate the waste toner in the first waste toner containing part 77 and to accommodate the waste toner which failed to be accommodated in the second waste toner containing part 90. Accordingly, even after the first waste toner containing part 77 is almost filled with the waste toner, if the intermediate transfer belt unit 70 has not reached the replacement cycle (life) yet, the image forming continues without the replacement of the intermediate transfer belt unit 70. In addition, the amount of the waste toner in the first waste toner containing part 77 does not need to be detected.

In addition, due to the above-mentioned configurations, even though the respective volumes of the first waste toner containing part 77 and the second waste toner containing part 90 have a limit, a sufficient amount of waste toner is accommodated. Moreover, since the first waste toner containing part 77 is provided in the intermediate belt unit 70, the image forming apparatus is downsized.

Further, the first waste toner containing part 77 is configured so as to communicate to the second waste toner containing part 90 at the respective upper parts thereof (the upper side portions in the gravitational direction) by the duct 105, and is configured so as to carry the waste toner to the second waste toner containing part 90 by the waste toner carrying duct 100 carrying the waste toner to the first waste toner containing part 77. Accordingly, when the first waste toner containing part 77 is almost filled with the waste toner, the waste toner is carried to, and is accommodated in, the second waste toner containing part 90 by the auger 107. That is, a special mechanism for switching the first/second waste toner containing parts 77, 90 does not need to be provided.

In addition, since the first waste toner containing part 77 is provided in the intermediate transfer belt unit 70 which is a consumable item, the intermediate transfer belt unit 70 is replaced due to the arrival of the replacement cycle, the first waste toner containing part 77 is replaced without separately performing a work to replace the first waste toner containing part 77, it is possible to accommodate waste toner again. In this case, the volume of the second waste toner containing part 90 is not unnecessarily used.

In addition, the second waste toner containing part 90 may be configured, for example, as a box-shaped container in the downstream side of the first waste toner containing part 77 in the carrying direction of the waste toner, and a special mechanism for carrying the waste toner does not need to be provided. Therefore, a shape of the second waste toner containing part 90 is formed to have a shape which coincides with the mount space in the device main body 1, and the second waste toner containing part 90 is easily mounted to the device main body 1.

In the first embodiment, the auger 107 is also configured so as to carry the waste toner in the belt cleaning part 76. However, a portion which carries the waste toner in the belt cleaning part 76 may be configured with another auger. In addition, the auger 107 may be configured so as not to extend through the first waste toner containing part 77.

Moreover, in the first embodiment, the auger 107 which carries the waste toner to the first waste toner containing part 77 extends to the second waste toner containing part 90 to securely carry the waste toner to the second waste toner containing part 90. However, the embodiment is not limited to such a configuration, and the embodiment may be configured to carry the waste toner from the first waste toner containing part 77 to the second waste toner containing part 90.

Figure 11:
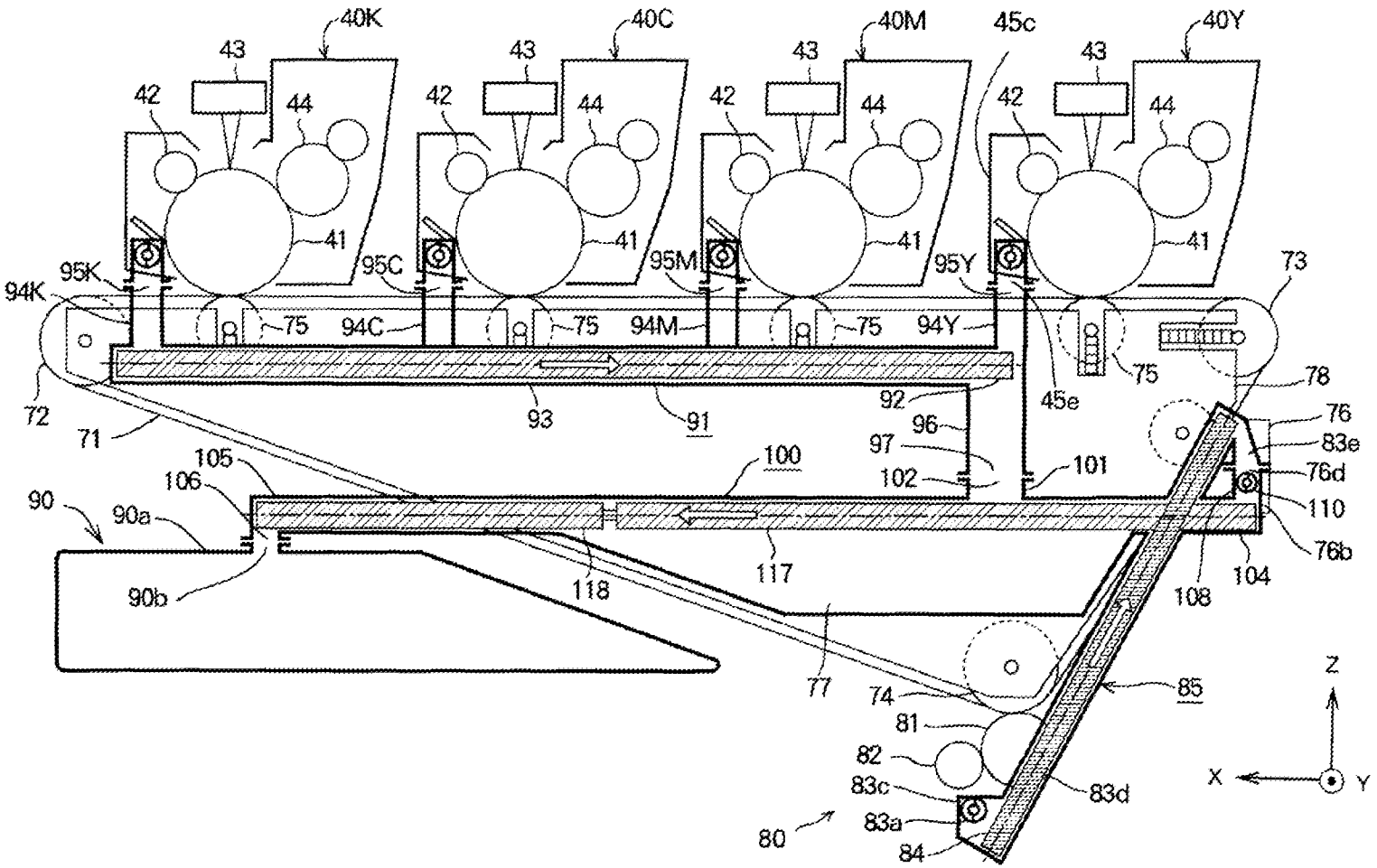
FIG. 11 is a diagram for explaining a modification of a shape of an auger in the first embodiment.

Further, for example, in the manner of the modification shown in FIG. 11, augers 117, 118 divided into two or more may be used instead of the single auger 107.

Figure 12:
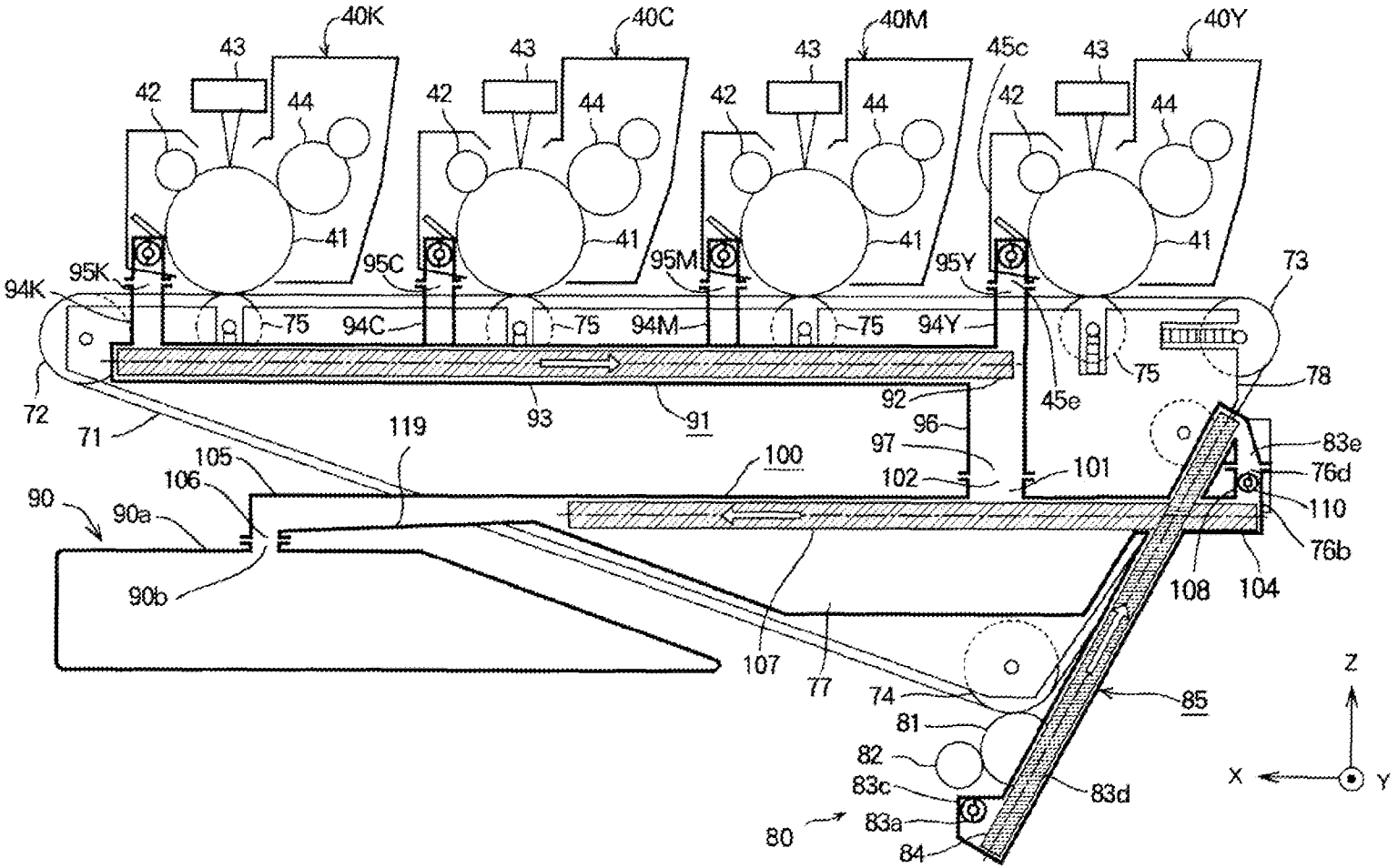
FIG. 12 is a diagram for explaining a modification of a shape of a duct part in the first embodiment.

Furthermore, in the manner of the modification shown in FIG. 12, a lower surface 119 (guide surface) of the duct 105 may be inclined toward the second waste toner containing part 90 to slide the waste toner which has overflowed from the first waste toner containing part 77 on the inclined surface 119 and to carry the waste toner to the second waste toner containing part 90.

Second Embodiment

Figure 13:
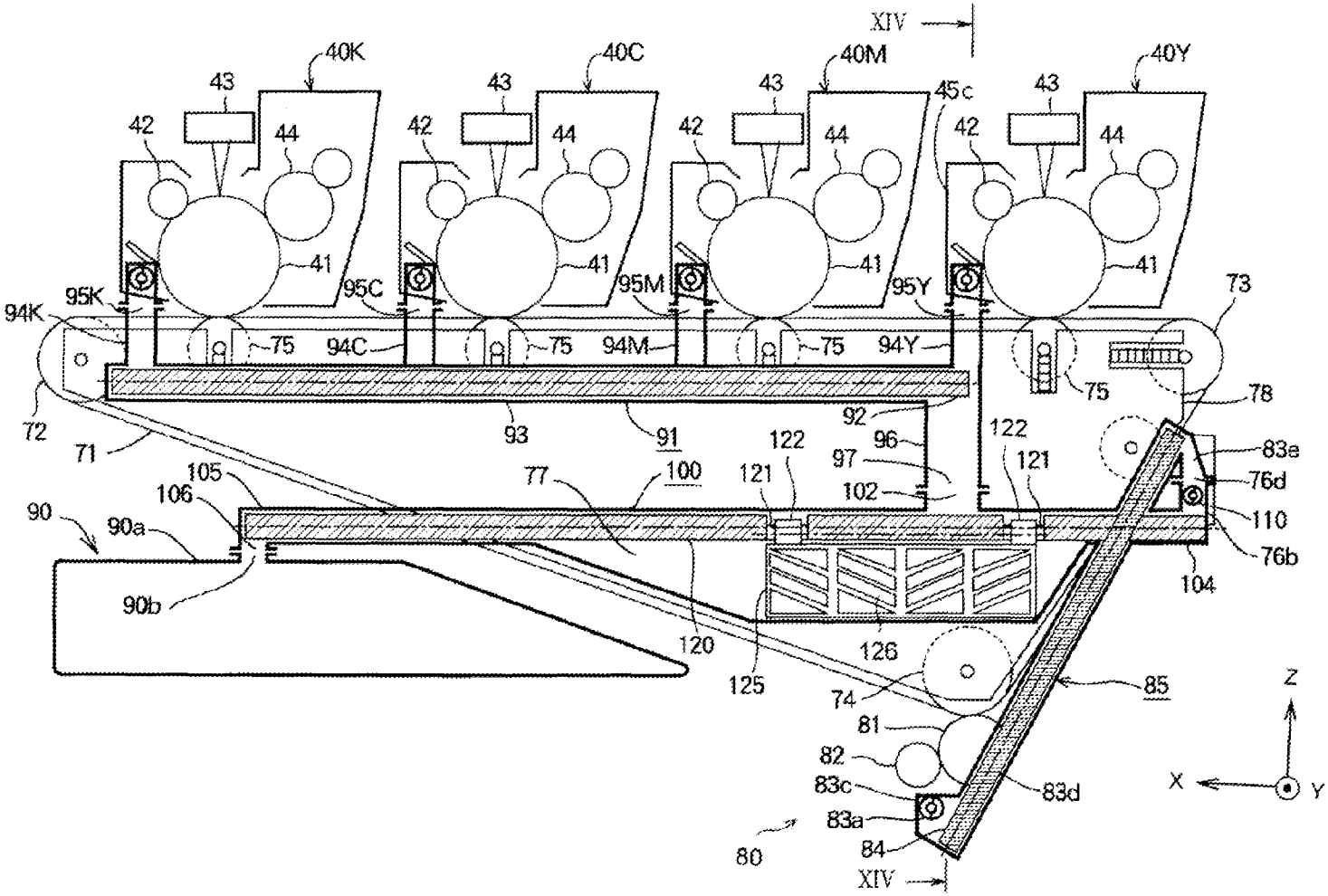
FIG. 13 is a side view of an image forming part, an intermediate transfer belt unit, a secondary transfer roller unit and a second waste toner containing part in a second embodiment of the present invention viewed from the same side as FIG. 4.

FIG. 13 is a view of the image forming part 40, the intermediate transfer belt unit 70, the secondary transfer roller unit 80 and the second waste toner containing part 90 in the second embodiment of the present invention viewed from the same side with FIG. 4. The same reference numbers are given for compositions that are identical with the compositions explained in the first embodiment.

In the second embodiment, an auger 120 as a first developer carrying member is included instead of the above-discussed auger 107 (FIG. 4). The auger 120 includes an eccentric shaft 121 in a substantially center part in the longitudinal direction. An agitation member 125 is attached to the eccentric shaft 121. The eccentric shaft 121 is a shaft part formed at a position shifted from a rotational shaft (rotation center) of the auger 120 by a predetermined amount.

The agitation member 125 is a substantially plate-shaped member through which a plurality of holes 126 are formed, and is slidably attached to the eccentric shaft 121 in a root portion (shaft part) 122 of the agitation member 125. The agitation member 125 operates to agitate the waste toner accommodated in the first waste toner containing part 77.

Figure 14A:
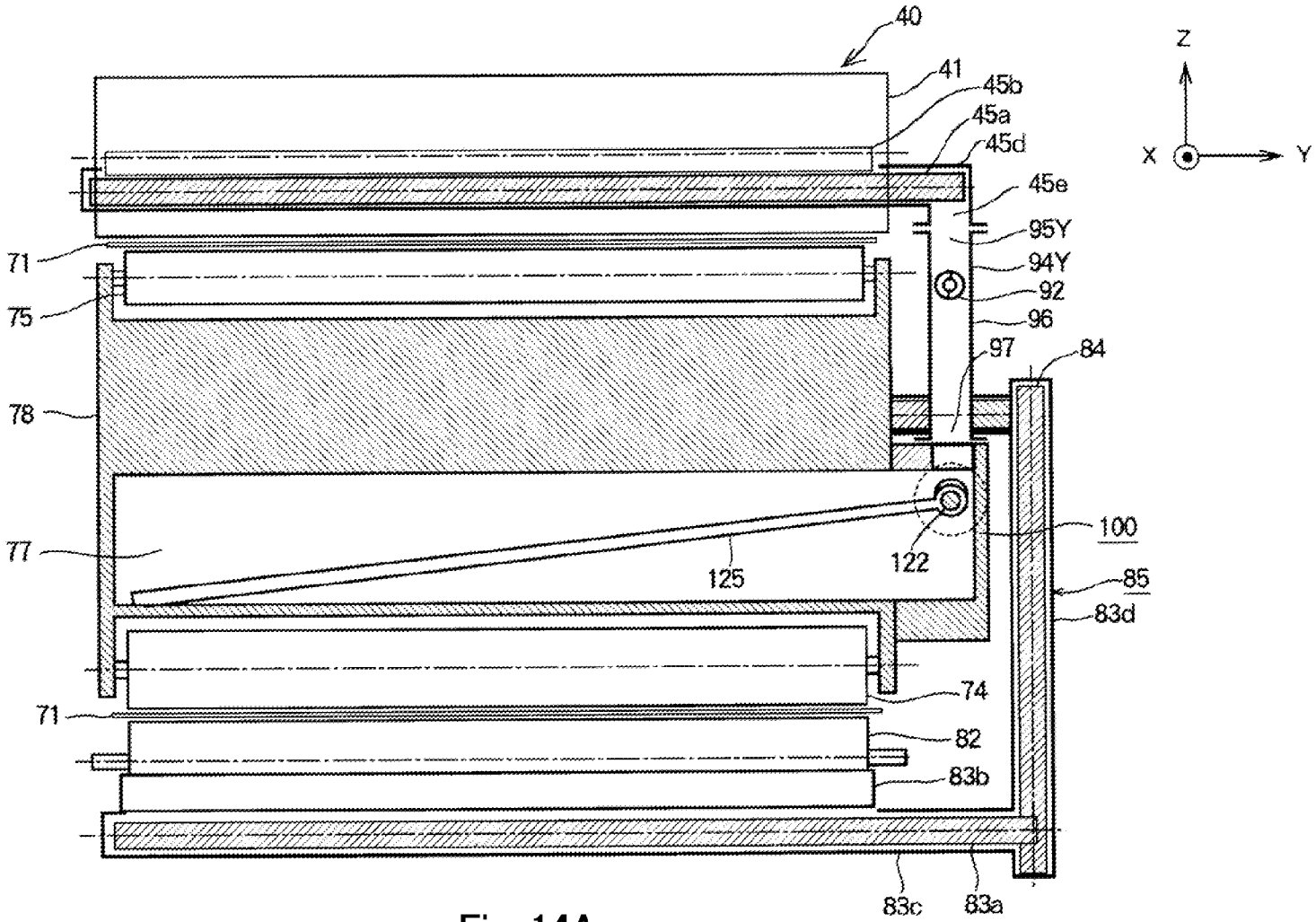
FIG. 14A is a cross-sectional view along a line XIV-XIV in FIG. 13 in a direction viewed from an arrow illustrating.
Figure 14B:
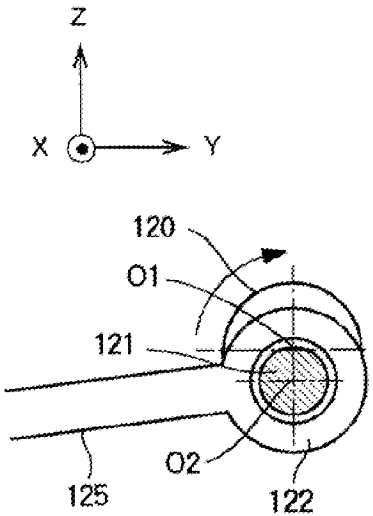
FIG. 14B is a partially enlarged view of the cross-sectional view in FIG. 14A.

FIG. 14A is a cross-sectional view along a line XIV-XIV in FIG. 13 in a direction viewed from the arrow direction. FIG. 14B is a partially enlarged view of FIG. 14A. As shown in FIG. 14B, a hole part is formed in the shaft part 122 of the agitation member 125, and the hole part slidably meshes with the periphery surface of the eccentric shaft 121 of the auger 120. A rotation center O1 of the auger 120 is shifted from a center 02 of the eccentric shaft 121 at the predetermined amount. When the auger 120 rotates in the clockwise direction in the figure for carrying the waste toner, as shown in FIG. 14A, the agitation member 125 swings in the Y direction in a state that the front edge of the agitation member 125 contacts the bottom of the first waste toner containing part 77.

<Operation>

Figure 15A:
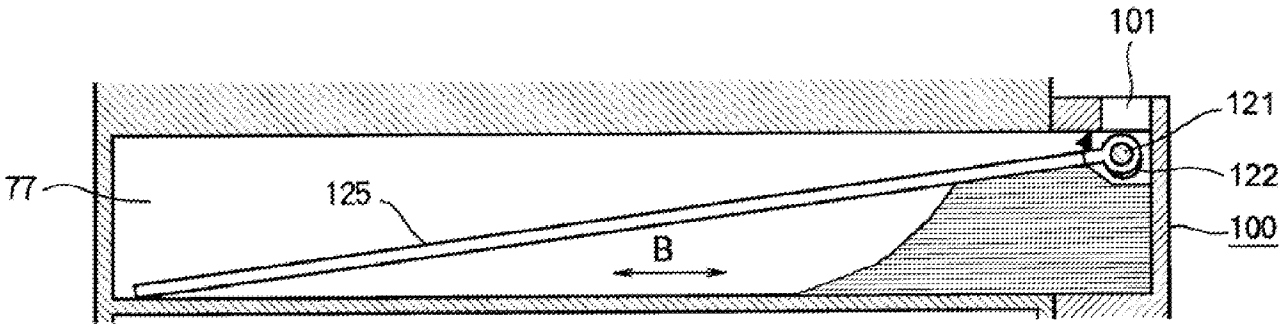
FIGS. 15A-15C are a diagram illustrating an operation of an agitation member in the second embodiment.
Figure 15B:
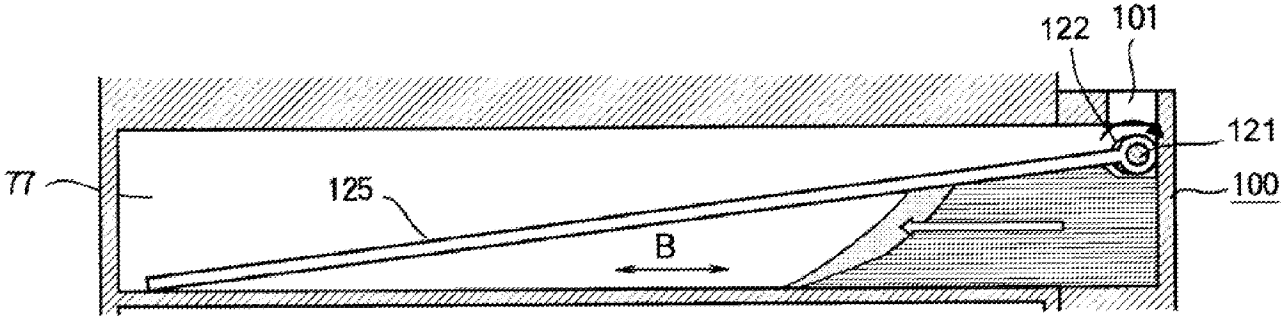
Figure 15C:
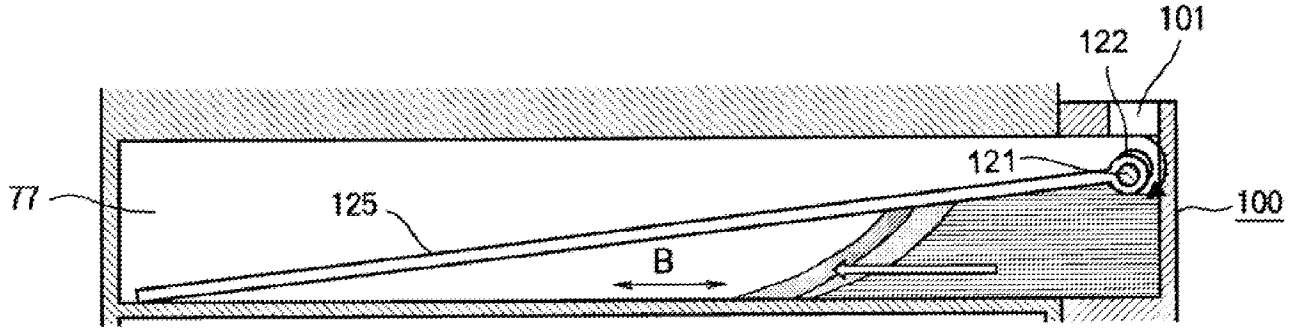

FIGS. 15A-15C are diagrams illustrating an operation of the agitation member 125 in the second embodiment. As shown in FIG. 15A, the waste toner accommodated in the first waste toner containing part 77 starts to accumulate from a region in the right side in the figure positioned in the lower direction of the duct part 101. In this state, when the auger 120 rotates in the clockwise direction (arrow direction), the agitation member 125 swings in the direction indicated by arrow B (Y direction) in the state that the front edge of the agitation member 125 contacts the bottom of the first waste toner containing part 77. Thereby, the waste toner is sent in the left direction in the figure (FIG. 15B).

As shown in FIG. 15C, when the auger 120 continues to rotate, the waste toner is further sent in the left direction in the figure by the swing of the agitation member 125. As mentioned above, when the auger 120 continues to rotate for carrying the waste toner, the agitation member 125 repeats the swing to send the waste toner in the left direction in the figure. Thereby, the first waste toner containing part 77 is efficiently filled with the waste toner.

As described above, according to the second embodiment of the present invention, the effects of the first embodiment are obtained. In addition, the first waste toner containing part 77 is sufficiently filled with the waste toner by the agitation member 125. Thereby, a collection efficiency of the waste toner is improved.

Here, the plate-shaped agitation member 125 is used. However, the embodiment is not limited to such a configuration, and may be configured to have a shape which can send the waste toner by the rotation of the auger 120. In addition, here, the agitation member 125 is driven by using the rotation of the auger 120. However, the agitation member 125 may be driven by another method.

In each above-mentioned embodiment, configurations for collecting waste toner generated in the image forming part 40 and the like are explained. However, the present invention is not limited to the configuration for collecting the waste toner, and may be implemented in a configuration for collecting a developer.

In addition, in each above-mentioned embodiment, the first waste toner containing part 77 (first developer containing part) is fixedly set up in the intermediate transfer belt unit 70. However, it is enough that the first waste toner containing part 77 is fixedly set up in a unit removable from the device main body 1.

In addition, in each above-mentioned embodiment, the image forming apparatus which forms the developer image by the four process unit and transfers the developer image on the medium via the intermediate transfer belt are explained. However, the present invention is not limited to such an image forming apparatus and may be implemented in a direct transfer method image forming apparatus which directly transfers a developer image from a process unit onto a medium. In addition, the present invention may be implemented in a monochrome image forming apparatus using one process unit. In addition, the present invention may be implemented in a printer, a photocopy machine, an automatic manuscript reading device and the like.

What is claimed is:

1. An image forming apparatus, comprising:

a first developer containing part accommodating a developer that is ejected after a depeloper image is formed;

a second developer containing part;

a communication part allowing the first developer containing part and the second developer containing part to communicate each other; and a first developer carrying member carrying the developer to the first developer containing part to the communication part, wherein the communication part carries the developer carried by the first developer carrying member to the second developer containing part.

2. The image forming apparatus of claim 1, further comprising an image forming part forming the developer image; and a second developer carrying member carrying the developer ejected from the image forming part to the first developer containing part.

3. The image forming apparatus of claim 1, wherein when an amount of the developer accommodated in the first developer containing part reaches a predetermined amount, the first developer carrying member carries the developer to the second developer containing part.

4. The image forming apparatus of claim 1, wherein the developer carrying member extends in a downstream side of the first developer containing part in the carrying direction of the developer and carries the developer to the second developer containing part.

5. The image forming apparatus of claim 1, wherein the first developer carrying member is provided in an upper part side of the first developer containing part in a gravitational direction.

6. The image forming apparatus of claim 1, wherein a replacement cycle of the first developer containing part is shorter than a replacement cycle of the second developer containing part.

7. The image forming apparatus of claim 1, wherein the first developer containing part is formed as a replaceable unit that is removable from a device main body of the image forming apparatus, and the second developer containing part is provided in the device main body.

8. The image forming apparatus of claim 6, wherein the communication part is a duct part provided in the device main body, and when the replaceable unit is removed from the device main body, the duct part and an opening part of the second developer containing part facing the duct part are separated from each other.

9. The image forming apparatus of claim 1, wherein the communication part includes a guide surface inclining toward the second developer containing part.

10. The image forming apparatus of claim 1, further comprising:

an agitation member agitating the developer in the first developer containing part.

11. The image forming apparatus of claim 10, wherein the agitation member is driven by the first developer carrying member.

12. The image forming apparatus of claim 1, further comprising:

at least one image forming part; and an endless belt moving while contacting at least one of the image forming part, wherein the first developer containing part is provided in a region surrounded by the belt, the second developer containing part is provided in a region outside the belt, and the communication part is provided in outside a width direction of the belt and allows the first developer containing part to communicate with the second developer containing part.

13. The image forming apparatus of claim 12, further comprising:

a developer collection mechanism carrying the developer from the at least one image forming part to the first developer containing part.

14. The image forming apparatus of claim 1, wherein a plurality of image forming part are arranged in one direction, and the first developer containing part and the second developer containing part are arranged in and lines in an arrangement direction of the plurality of image forming part.

15. A developer collection device, comprising:

an image carrier carrying a developer image on a surface thereof;

a first developer containing part accommodating the developer;

a developer collection mechanism carrying the developer to the first developer containing part;

a developer carrying mechanism carrying the developer from the first developer containing part; and a second developer containing part accommodating the developer carried by the developer carrying mechanism and being removable from a device main body, wherein the second developer containing part is provided in an internal region of the image carrier.

16. The developer collection device of claim 15, wherein the image carrier is an intermediate transfer belt transferring the developer image to a recording medium.

17. The developer collection device of claim 16, wherein at least one of the developer collection mechanism and the developer carrying mechanism includes an auger carrying the developer and a duct part provided so as to surround the auger and to guide a developer.

18. The developer collection device of claim 15, wherein the developer carrying mechanism is provided so as to extend through the first developer containing part.

19. The developer collection device of claim 15, further comprising:

an agitation member agitating so as to evenly spread the developer in the first developer containing part, wherein the agitation member is driven by the developer carrying mechanism.

20. An image forming apparatus including the developer collection device of claim 15.

* * * * *